US009007412B2

(12) United States Patent
Takahashi et al.

(10) Patent No.: US 9,007,412 B2
(45) Date of Patent: Apr. 14, 2015

(54) ELECTRONIC DEVICE

(71) Applicants: Toshihiro Takahashi, Nagoya (JP); Keiji Seo, Nagoya (JP); Hidenori Jo, Nagoya (JP); Yuki Nagashima, Nagoya (JP)

(72) Inventors: Toshihiro Takahashi, Nagoya (JP); Keiji Seo, Nagoya (JP); Hidenori Jo, Nagoya (JP); Yuki Nagashima, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/094,958

(22) Filed: Dec. 3, 2013

(65) Prior Publication Data

US 2014/0085395 A1 Mar. 27, 2014

Related U.S. Application Data

(63) Continuation-in-part of application No. PCT/JP2012/057648, filed on Mar. 23, 2012.

(30) Foreign Application Priority Data

Jun. 3, 2011 (JP) ..... 2011-125550

(51) Int. Cl.

| | |
|---|---|
| ***B41J 29/00*** | (2006.01) |
| ***B41J 29/02*** | (2006.01) |
| ***B41J 15/04*** | (2006.01) |
| ***B41J 29/13*** | (2006.01) |

(52) U.S. Cl.

CPC ..... *B41J 29/00* (2013.01); *B41J 15/042* (2013.01); *B41J 29/02* (2013.01); *B41J 29/13* (2013.01)

(58) Field of Classification Search

USPC ..... 347/222

See application file for complete search history.

(56) References Cited

U.S. PATENT DOCUMENTS

| | | | | |
|---|---|---|---|---|
| 6,118,469 | A * | 9/2000 | Hosomi | 347/222 |
| 8,096,716 | B2 | 1/2012 | Kobayashi et al. | |

FOREIGN PATENT DOCUMENTS

| | | |
|---|---|---|
| JP | 350177 | 5/1991 |
| JP | 53559 | 1/1993 |
| JP | 08312231 | 11/1996 |
| JP | 2001205895 | 7/2001 |

(Continued)

OTHER PUBLICATIONS

Computer-generated translation of JP 08-312231, published on Nov. 1996.*

(Continued)

*Primary Examiner* — Huan Tran

(74) *Attorney, Agent, or Firm* — McCarter & English, LLP

(57) ABSTRACT

The disclosure discloses an electronic device comprising an opening/closing cover. One of the opening/closing cover and a housing includes a shaft portion, and the other thereof includes a bearing hole portion. The shaft portion includes a first protruding portion. The bearing hole portion includes a second protruding portion. The first and the second protruding portions are configured, to be separated away from each other when the opening/closing cover is in a closed state, to become closer to each other along with rotation from the closed state, to be in contact with each other when the opening/closing cover arrives at a first rotation position, and configured to release an engagement of the shaft portion and the bearing hole portion by the manner that one of the first and second protruding portions overrides the other thereof to overlap each other when the opening/closing cover arrives at a second rotation position.

4 Claims, 25 Drawing Sheets

(56) References Cited

FOREIGN PATENT DOCUMENTS

| | | | | |
|---|---|---|---|---|
| JP | 2003318564 | | 11/2003 | |
| JP | 2005-212139 | * | 11/2005 | ..... B41J 2/32 |
| JP | 2009028977 | | 2/2009 | |
| JP | 2010238851 | | 10/2010 | |
| JP | 2011000764 | | 1/2011 | |

OTHER PUBLICATIONS

Computer-generated translation of JP 2011-000764, published on Jan. 2011.*

Computer-generated translation of JP 2003-318564, published on Nov. 2003.*

Computer-generated translation of JP 2005-212139, published on Nov. 2005.*

International Preliminary Report on Patentability issued in Application No. PCT/JP2012/057648 on Dec. 19, 2013.

International Search Report issued in PCT/JP2012/057648, on Dec. 4, 2013.

Japanese Office Action issued in Japanese Application No. 2011-125550 on Nov. 13, 2014.

* cited by examiner

ELECTRONIC DEVICE

CROSS-REFERENCE TO RELATED APPLICATION

This is a CIP application PCT/JP2012/057648, filed Mar. 23, 2012, which was not published under PCT article 21(2) in English.

BACKGROUND

1. Field

The present disclosure relates to an electronic device, in which an opening portion of a housing is opened/closed with an opening/closing cover.

2. Description of the Related Art

An electronic device, in which an opening portion disposed on a housing forming an outer framework of an apparatus is opened/closed by manually operating a rotatable opening/closing cover, for example, is known. In an electronic device (tape print apparatus) according to a prior art, an opening/closing cover (top cover) for opening/closing the opening portion of the housing (housing of a main body) is arranged. The opening/closing cover is rotatably engaged with the housing via a hinge portion disposed on a rear face side of the housing.

In such a rotatable engagement structure as the hinge portion according to the above described prior art, it is generally desirable that the engagement be released when a rotation action is performed over a predetermined range, so as to prevent the engagement structure from being damaged when too much force for operating an opening/closing cover is applied to generate an excessive load. However, the above described prior art does not take into account the above described problem, and thus the engagement between the opening/closing cover and the housing cannot be released.

SUMMARY

The object of the present disclosure is to provide the electronic device that can reliably prevent the device itself from being damaged by releasing the opening/closing cover from the housing to remove the excessive load even when the excessive load is erroneously applied to the opening/closing cover.

In order to achieve the above-described object, according to the aspect, there is provided an electronic device comprising a housing that forms an outer frame of the device and includes an opening portion, and an opening/closing cover configured to open/close the opening portion, one of the opening/closing cover and the housing including a shaft portion having a predetermined axis, the other of the opening/closing cover and the housing including a bearing hole portion engaging with the shaft portion rotatably about the axis, the shaft portion including a first protruding portion in a part of an area in a circumferential direction of the shaft portion, the bearing hole portion including a second protruding portion in a part of an area in a circumferential direction of the bearing hole portion, and the first protruding portion and the second protruding portion being, configured to be separated away from each other in the circumferential direction when the opening/closing cover is in a closed state, configured to become closer to each other in a distance in the circumferential direction along with rotation in an opening direction from the closed state of the opening/closing cover, configured to be in contact with each other when the opening/closing cover arrives at a first rotation position, and configured to release an engagement of the shaft portion and the bearing hole portion by the manner that one of the first protruding portion and second protruding portion overrides the other of the first protruding portion and second protruding portion to overlap each other in a direction of the axis when the opening/closing cover is further rotated in the opening direction from the first rotation position to arrive at a second rotation position.

According to the present disclosure, the opening portion disposed on the housing is opened/closed by manually operating the opening/closing cover. The opening/closing cover is supported rotatably with respect to the housing via the engagement structure by a shaft portion and bearing hole portion.

At this point, so as to release the above described engagement depending on a rotation position of the opening/closing cover, a first protruding portion is disposed on a part of an area of the shaft portion in a circumferential direction, and a second protruding portion is disposed on a part of an area of the bearing hole portion. When the opening/closing cover is in a closed state, the first protruding portion and the second protruding portion are separated away from each other in the circumferential direction. As the opening/closing cover is rotated in a direction for opening the opening/closing cover from the closed state, a distance between the first protruding portion and the second protruding portion in the circumferential direction is decreased to make the first protruding portion and the second protruding portion become closer to each other. When the opening/closing cover is further rotated in the opening direction to arrive at a first rotation position, the first protruding portion and the second protruding portion are abutted on each other.

When the opening/closing cover is further rotated in the opening direction to arrive at a second rotation position, the first protruding portion and the second protruding portion overlap each other in the shaft direction in such a manner that the first protruding portion overrides the second protruding portion (or, the second protruding portion overrides the first protruding portion). With this arrangement, a relative position in the shaft direction between the shaft portion and the bearing hole portion that have been engaged with each other is changed, and the engagement therebetween is loosened to release the engagement accordingly.

As described above, when a rotation angle of the opening/closing cover becomes larger to a certain degree, the engagement between the shaft portion and the bearing hole portion is released to remove the opening/closing cover from the housing. As a result, even when the excessive load is erroneously applied to the opening/closing cover, it is possible to prevent the device itself from being damaged by releasing the opening/closing cover from the housing to remove the excessive load.

DETAILED DESCRIPTION OF THE PREFERRED EMBODIMENTS

Figure 1:
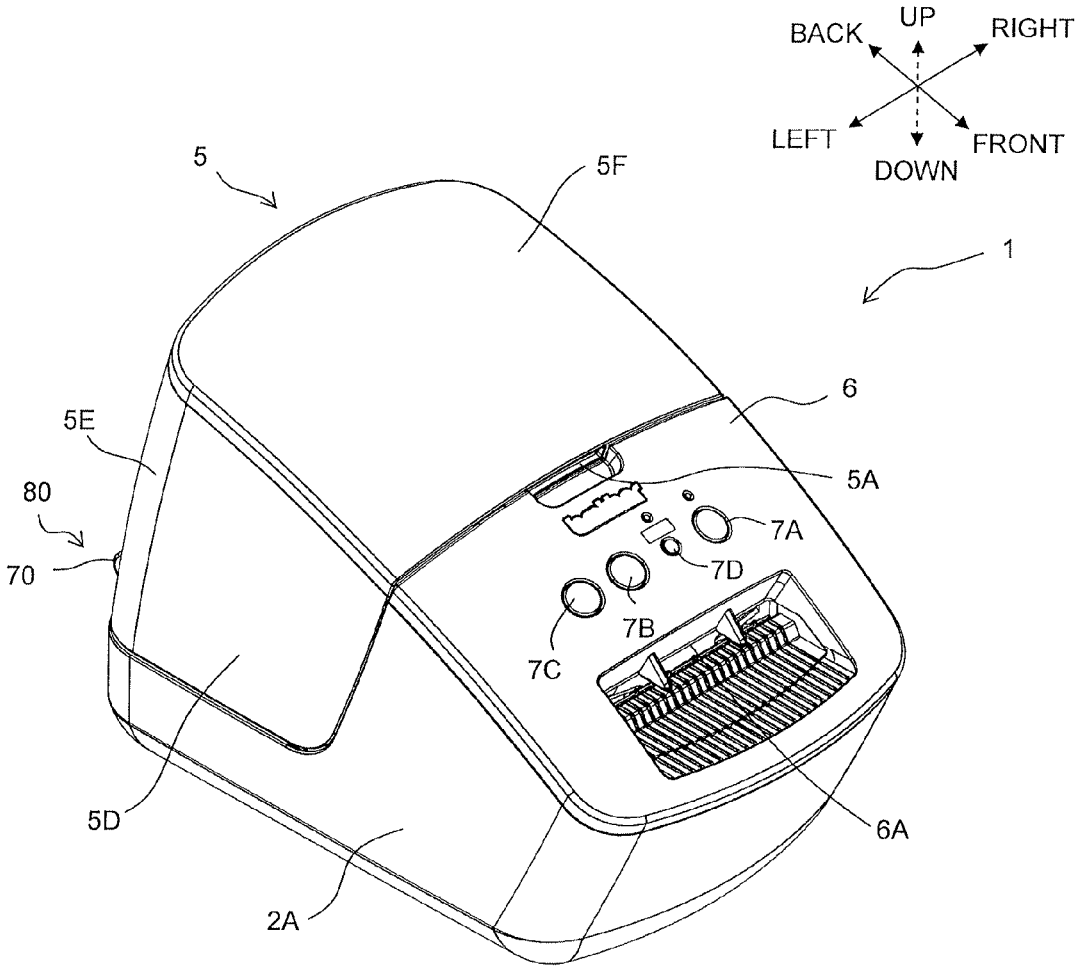
FIG. 1 is a perspective view illustrating an outer appearance of a print label producing apparatus according to the present embodiment.
Figure 2:
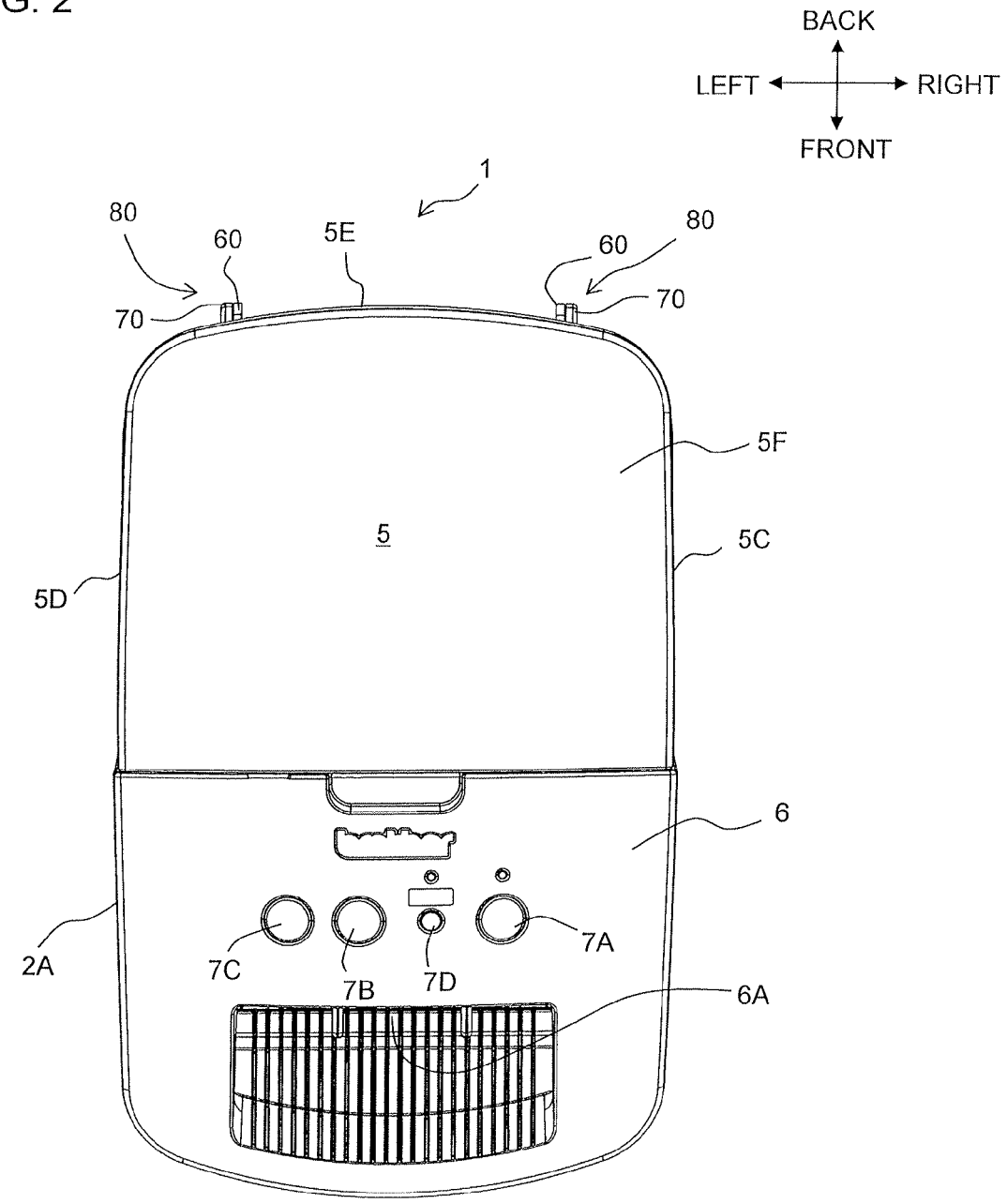
FIG. 2 is a plan view of the print label producing apparatus.
Figure 3:
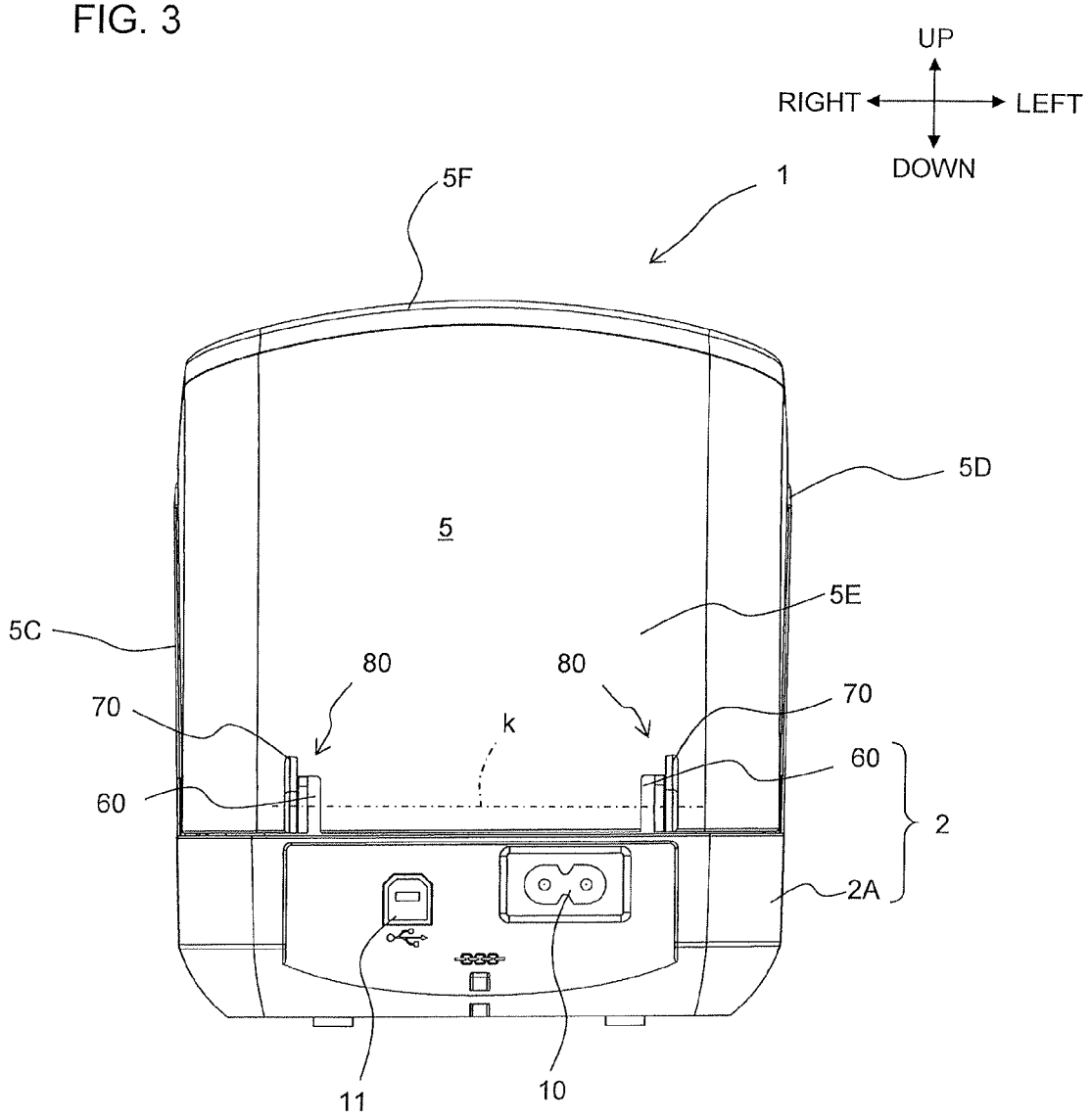
FIG. 3 is a rear view of the print label producing apparatus.

With reference to the drawings, an embodiment of the present disclosure will be described below.

The present embodiment is obtained by applying the present disclosure to a print label producing apparatus 1. First, with reference to FIGS. 1 to 12, an outline structure of the print label producing apparatus 1 according to the present embodiment including an opening/closing cover 5 for covering an upper side of a roll sheet holder will be described.

<Outline Structure of Print Label Producing Apparatus 1>

As illustrated in FIGS. 1 to 4, the print label producing apparatus 1 includes a housing 2 made of resin forming an outer frame of the print label producing apparatus 1 and including a roll sheet holder storage unit 4 storing a roll sheet holder 3 around which a roll sheet 3A having a predetermined width is wound and the opening/closing cover 5 that is made of transparent resin and mounted to be freely opened/closed onto an upper edge end portion at a back side of the print label producing apparatus 1 to cover an upper side of the roll sheet holder storage unit 4 via a pair of right and left hinge portions 80 (a hinge bracket 70 will be described below) at the back side thereof.

The roll sheet 3A is made of a long thermo-sensitive sheet (so called, thermal paper) having a self-chromogenic property or a long label sheet obtained by attaching separation paper onto one side of the thermo-sensitive sheet via adhesive, and wound around the roll sheet holder 3.

The housing 2 includes a housing main body 2A and a pair of right and left hinge arms 60, 60 protrudingly disposed on a back portion of the housing main body 2A. The opening/closing cover 5 is supported by the above described hinge arms 60, 60 to rotate about an axis "k" (refer to FIGS. 3, 9, 12) of the hinge portion 80 so that an opening portion OP above the roll sheet holder storage unit 4 is opened/closed by the rotation. The opening/closing cover 5 is integrally formed such that a left wall face 5D disposed to a left side, a right wall face 5C disposed to a right side, and an intermediate wall face 5E extendedly disposed to connect the left wall face 5D with the right wall face 5C substantially in a U shape. Further, the opening/closing cover 5 is mounted with a top plate 5F made of a different member from that of the left wall face 5D, the intermediate wall face 5E, and the right wall face 5C to cover inner edge portions of the left wall face 5D, the intermediate wall face 5E, and the right wall face 5C in the substantially U shape.

A front cover 6 at a front side of the opening/closing cover 5 is formed with a sheet discharging exit 6A for discharging the printed roll sheet 3A to an outside. Total four buttons are substantially, horizontally disposed that include a power source button 7A at a front face portion of the upper side of the sheet discharging exit 6A, a cut button 7B for, when being pressed, driving a cutter unit 8 (refer to FIG. 5 described below) disposed on an inside of the sheet discharging exit 6A and cutting the roll sheet 3A into a desired length to generate the print label (not illustrated), a feed button 7C for discharging the roll sheet 3A in a feeding direction while being pressed, and another button 7D.

At the left side of a front of a recessed portion 5A of the opening/closing cover 5, a pressing nail portion 5B protruding by a predetermined length in a forward direction is disposed. There is disposed an opening/closing cover detection switch 18 including a micro switch that determines whether the pressing nail portion 5B has been pressed, in other words, whether or not the opening/closing cover 5 is closed, at a position of the housing 2 on which the pressing nail portion 5B is abutted when the opening/closing cover 5 is closed.

On a rear face portion of the housing 2, an inlet 10 to which a power source code (not illustrated) is connected is provided, and at a side (left side in FIG. 3) of the inlet 10, a universal serial bus (USB) connector 11 to be connected to a personal computer (not illustrated) or the like is disposed.

<Details of Roll Sheet Holder Storage Unit>

As illustrated in FIGS. 4 to 8, a holder supporting member 23 is provided on one side edge end portions (side edge end portion at the right side in FIG. 4) in a substantially vertical direction with respect to the feeding direction of the roll sheet holder storage unit 4. The holder supporting member 23 is formed with a first positioning groove portion 24 that has a substantially longitudinally long U shape viewed from a side face and opens upward and toward both sides in a width direction. Thus, a mounting member 21 that has a substantially rectangular cross section and is protrudingly disposed on an outside direction of a positioning retaining member 20 constituting the roll sheet holder 3 can be fitted into the first positioning groove portion 24.

Figure 5:
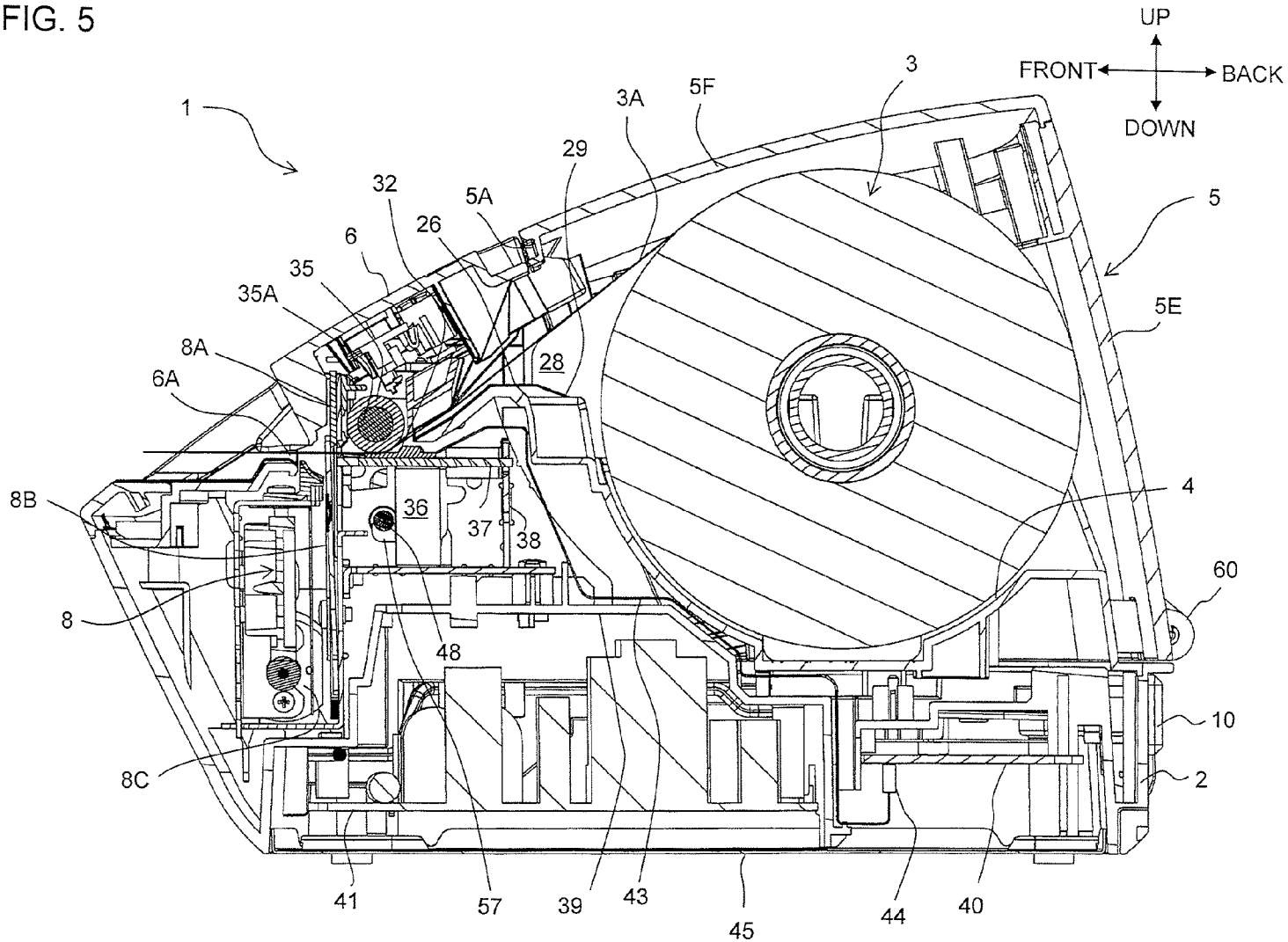
FIG. 5 is a side cross-sectional view illustrating the print label producing apparatus with the roll sheet holder mounted.

A loading portion 29 is disposed that is substantially, horizontally extended from a back edge end portion of an insertion opening 26 (refer to FIG. 5) via which the roll sheet 3A is inserted to an upper edge end portion of a front side of the roll sheet holder storage unit 4. Further, at an edge end corner portion of the back side of the loading portion 29 in the feeding direction, five second positioning groove portions 30A-30E each having a cross section in a substantially L shape are formed corresponding to a plurality of width dimensions of the roll sheet 3A. Each of the second positioning groove portions 30A-30E is formed such that a lower edge portion of a tip end abutted on the loading portion 29 of a guiding member 28 constituting the roll sheet holder 3 can be fitted in from above as illustrated in FIG. 5.

On a bottom face portion of the roll sheet holder storage unit 4, a positioning recessed portion 4A having a laterally long rectangular shape in a planar view is formed substantially vertically with respect to the feeding direction from a base edge portion of an inside of the holder supporting member 23 to the facing base edge portion of a side face portion by a predetermined depth. A width dimension of the positioning recessed portion 4A in the feeding direction is formed to be substantially equal to a width dimension of each lower edge end portion of the positioning retaining member 20 and the guiding member 28 constituting the roll sheet holder 3.

At the base edge portion of the inside of the holder supporting member 23 of the positioning recessed portion 4A, a discrimination recessed portion 4B is formed that has a longitudinally long rectangular shape in a planar view in the feeding direction. The discrimination recessed portion 4B faces a sheet discrimination portion (not illustrated) extended in a substantially right angle inside direction from the lower edge end portion of the positioning retaining member 20 and is formed to be located deeper than the positioning recessed portion 4A by a predetermined depth.

The discrimination recessed portion 4B includes the micro switch of a push type and five sheet discrimination sensors P1, P2, P3, P4, P5 that each discriminate a type, a material, and a width of the roll sheet of the roll sheet 3A and are arranged in an L-like shape. Each of the sheet discrimination sensors P1-P5 includes a known machine-type switch including a plunger and the micro switch, and an upper edge portion of each plunger is disposed in such a manner to protrude from a bottom face portion of the discrimination recessed portion 4B to a vicinity of the bottom face portion of the positioning recessed portion 4A. Each of the sheet discrimination sensors P1-P5 detects whether or not there are sensor holes (not illustrated) formed on the sheet discrimination portion extended from the lower edge end portion of the positioning retaining member 20 to the sensors P1-P5 in the substantially right angle inside direction, to further detect the type, the material, and the width of the roll sheet of the roll sheet 3A mounted on the roll sheet holder 3 with on/off signals.

According to the present embodiment, the plunger of each of the sheet discrimination sensors P1-P5 always protrudes from the bottom face of the discrimination recessed portion 4B almost to the vicinity of the bottom face portion of the positioning recessed portion 4A and the micro switch is set in an off state. When each sensor hole of the sheet discrimination portion is located at a position facing each of the sheet discrimination sensors P1-P5, the plunger is not pressed and the micro switch is set in the off state to output the off signal accordingly. On the other hand, when each sensor hole of the sheet discrimination portion is not located at the position facing each of the sheet discrimination sensors P1-P5, the plunger is pressed and the micro switch is set in the on state to output the on signal accordingly. Therefore, when a "0" or "1" signal of 5 bits is output by each of the sheet discrimination sensors P1-P5 and all of the sheet discrimination sensors P1-P5 are set in the off state, in other words, when the roll sheet holder 3 is not mounted, the signal of "00000" of 5 bits is output.

At the side edge end portion of the insertion opening 26 at a side of the holder supporting member 23, a guiding portion 31 is formed up to the back edge portion of the loading portion 29 in the substantially feeding direction to guide the roll sheet 3A up to the insertion opening 26. Here, the inside edge face 31A (left side edge face in FIG. 6) of the guiding portion 31 is formed to be located at a position facing the inside edge face of the positioning retaining member 20 fitted into the holder supporting member 23, in other words, to be located on a same plane. With this arrangement, a side edge end portion of the roll sheet 3A at an outside thereof drawn from the roll sheet holder 3 is abutted on the inside edge face of the guiding portion 31 and then guided to the insertion opening 26.

<Internal Devices Including Thermal Head Cutter Unit Etc.>

As illustrated in the above described FIGS. 5, 9, 10, 11, at an inside of the insertion opening 26 in the feeding direction of the roll sheet, a shaft of a platen roller 35 is rotatably supported. A thermal head 32 is fixed on an upper face of a head supporting member 37 upwardly urged by a pressing spring 36. An edge end portion of the head supporting member 37 at the back side in the feeding direction is supported slidably in a vertical direction by a rear face portion of a frame 38. On an inside of a peripheral edge of the opening portion OP of the housing 2, which faces the side edge end portion of the roll sheet holder storage unit 4 that is disposed to an opposite side of the holder supporting member 23, an engagement shaft 33 (refer to FIGS. 4, 7) formed to have a substantially equal height to a thickness of a link lever 34 having a circle shaped cross section is elevationally provided. An engagement nail portion 34A having a substantially C ring shape formed at one end edge portion of the link lever 34 causing the thermal head 32 to move vertically is fitted into the engagement shaft 33 via a notch portion 34B (refer to FIGS. 9, 11), and thus the end edge portion of the link lever 34 can be rotatably, removably mounted. The engagement nail portion 34A can expose a part of an outer peripheral portion of the engagement shaft 33 via the notch portion 34B, and still can cover other portions. When the opening/closing cover 5 is opened/closed, the link lever 34 is moved in a forward-and-backward direction, and then the thermal head 32 is vertically moved via a release lever 51 and a lever shaft 50 (refer to FIGS. 13 and 14 described below). In other words, with rotation of the lever shaft 50 along with the closing action of the opening/closing cover 5, the thermal head 32 upwardly urged by the pressing spring 36 presses and urges the roll sheet 3A onto the platen roller 35 to get ready for printing. Further, with rotation of the lever shaft 50 along with an opening action of the opening/closing cover 5 in an opposite direction of the direction described above, when the opening/closing cover 5 is opened, as described below, the thermal head 32 is separated away from the platen roller 35 and the roll sheet 3A is inserted through the insertion opening 26 to get ready for being further inserted between the platen roller 35 and the thermal head 32.

Figure 11A:
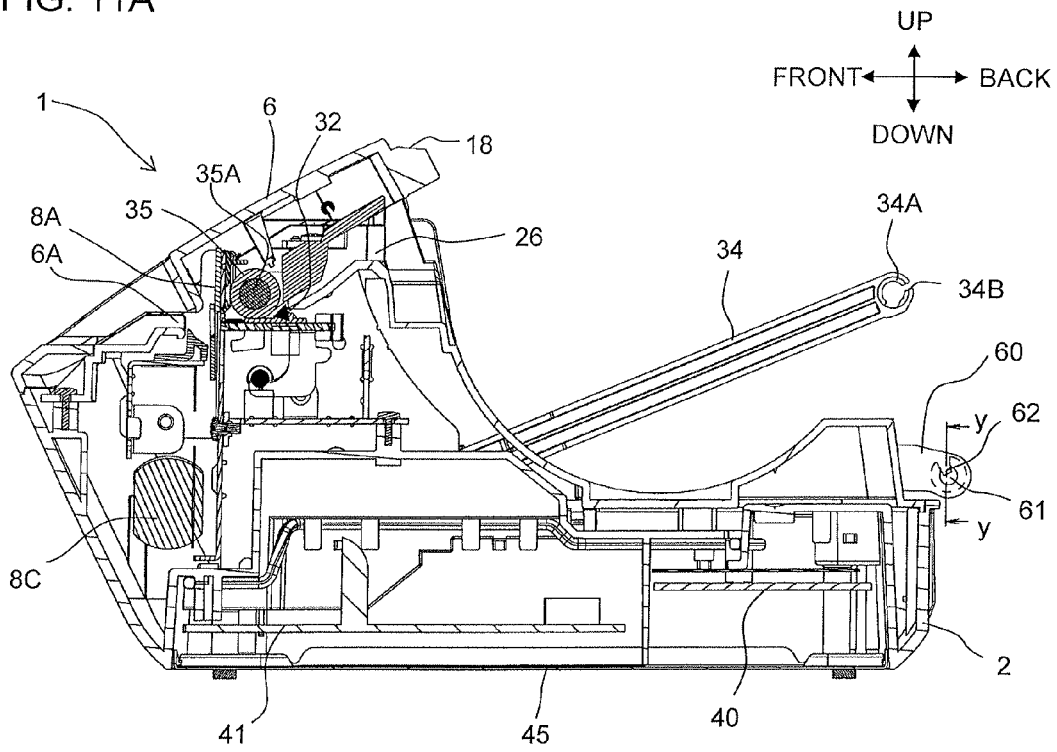
FIG. 11A is a side cross-sectional view taken along an a-a line in FIG. 10.
Figure 11B:
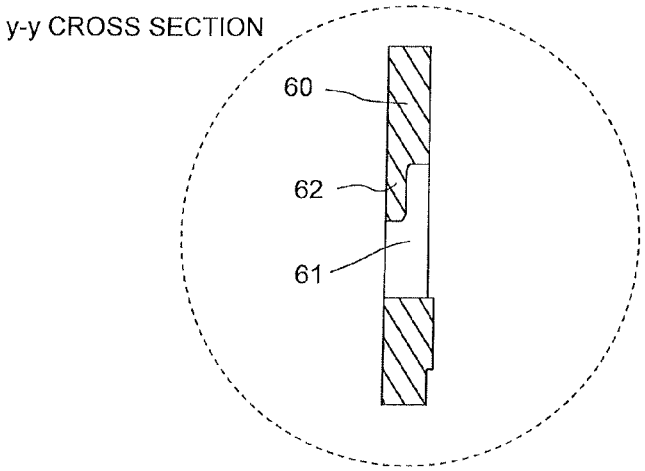
FIG. 11B is an enlarged cross-sectional view taken along a y-y line in FIG. 11A.

At a downstream side of the roll sheet 3A in the feeding direction (left side in FIGS. 5, 11A) from the platen roller 35 and the thermal head 32, the cutter unit 8 is disposed. As illustrated in FIGS. 5 and 11A, the cutter unit 8 includes a fixed blade 8A and a movable blade 8B. When the cut button 7B described above is pressed, the movable blade 8B is reciprocately moved in the vertical direction by a cutting motor 8C including a DC motor and the like. With this arrangement, the roll sheet 3A, on which printing has been performed by the above described thermal head 32, is cut into a desired length by the fixed blade 8A and the movable blade 8B to generate a print label, which is then discharged through the sheet discharging exit 6A. The movable blade 8B is formed in a V shape in a front view.

On the other hand, to a lower side of the roll sheet holder storage unit 4, a control substrate 40 is provided via a partition wall 39. The control substrate 40 is formed with a control circuit unit for driving and controlling each mechanism unit including the thermal head 32 according to an instruction from an external personal computer, and electrically connected to each of sheet discrimination sensors P1-P5. Further, below the frame 38, a power source substrate 41 formed with a power source circuit unit is disposed via the partition wall 39. The thermal head 32 is connected to a connector 44 disposed on a bottom face side of the control substrate 40 via a flexible flat cable (FFC) 43. The control substrate 40 and the power source substrate 41 are covered with a bottom face cover 45 made of a thin steel plate screwed onto the bottom face portion.

<Engagement when Opening/Closing Cover is Closed>

Figure 4:
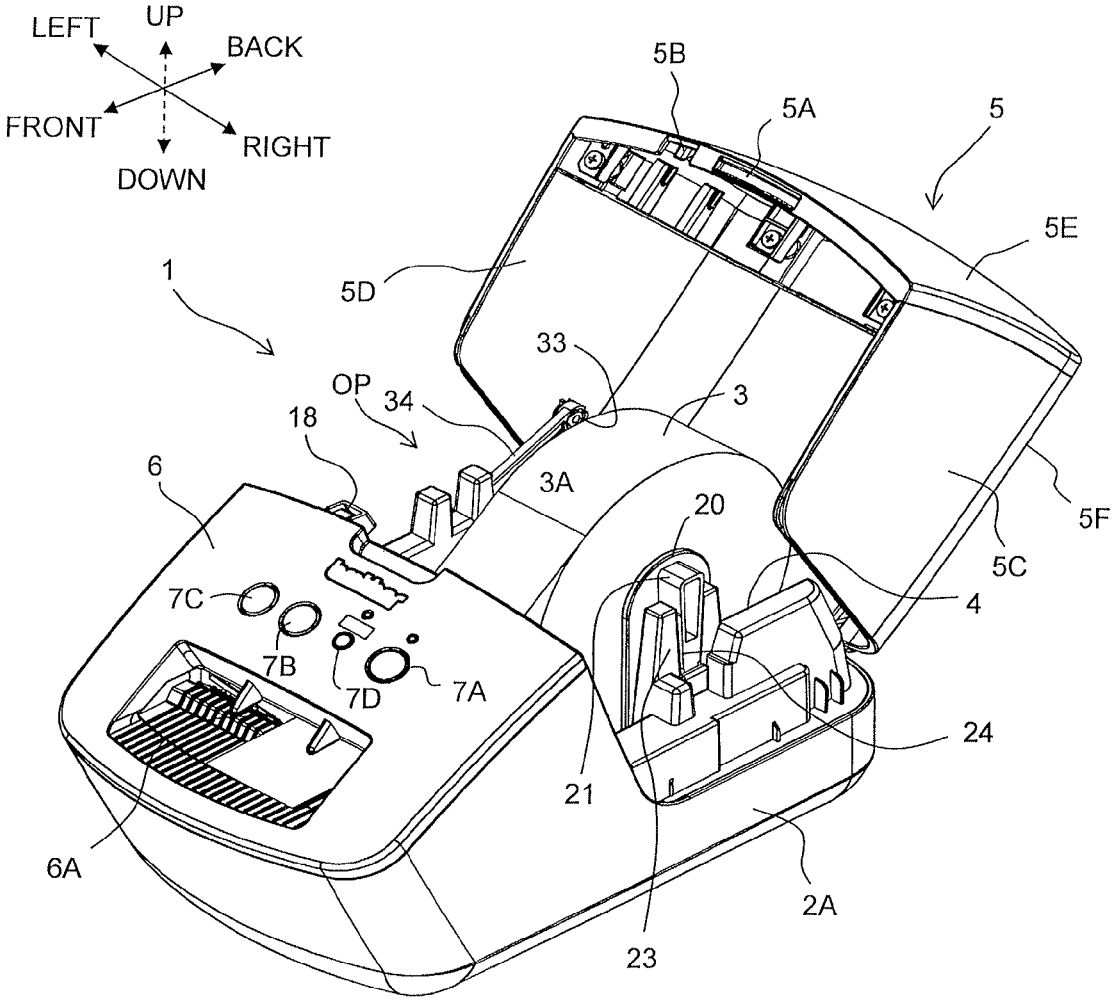
FIG. 4 is a perspective view illustrating the print label producing apparatus with a roll sheet holder mounted and an opening/closing cover opened.
Figure 6:
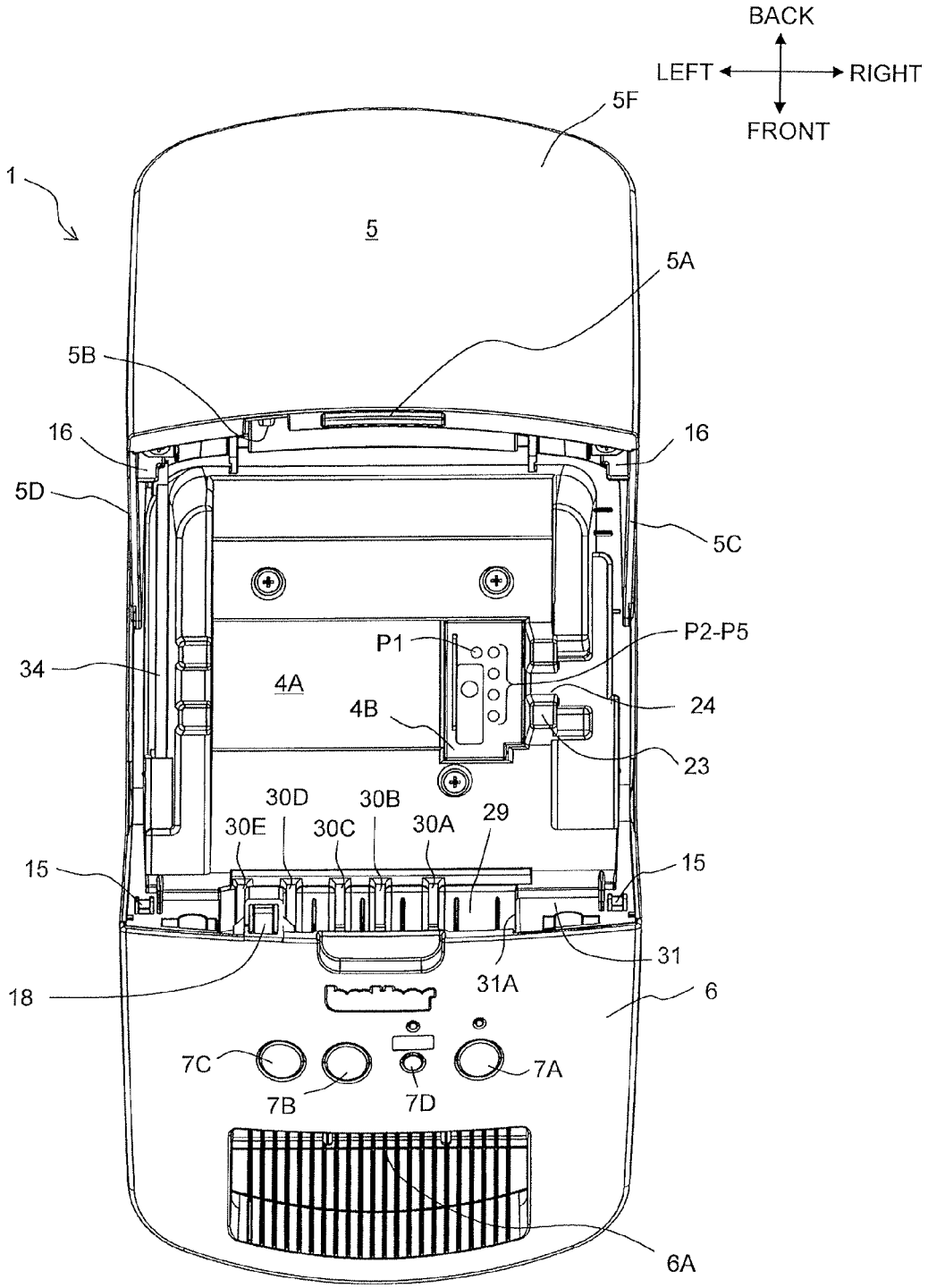
FIG. 6 is a plan view illustrating the print label producing apparatus with the opening/closing cover opened.
Figure 7:
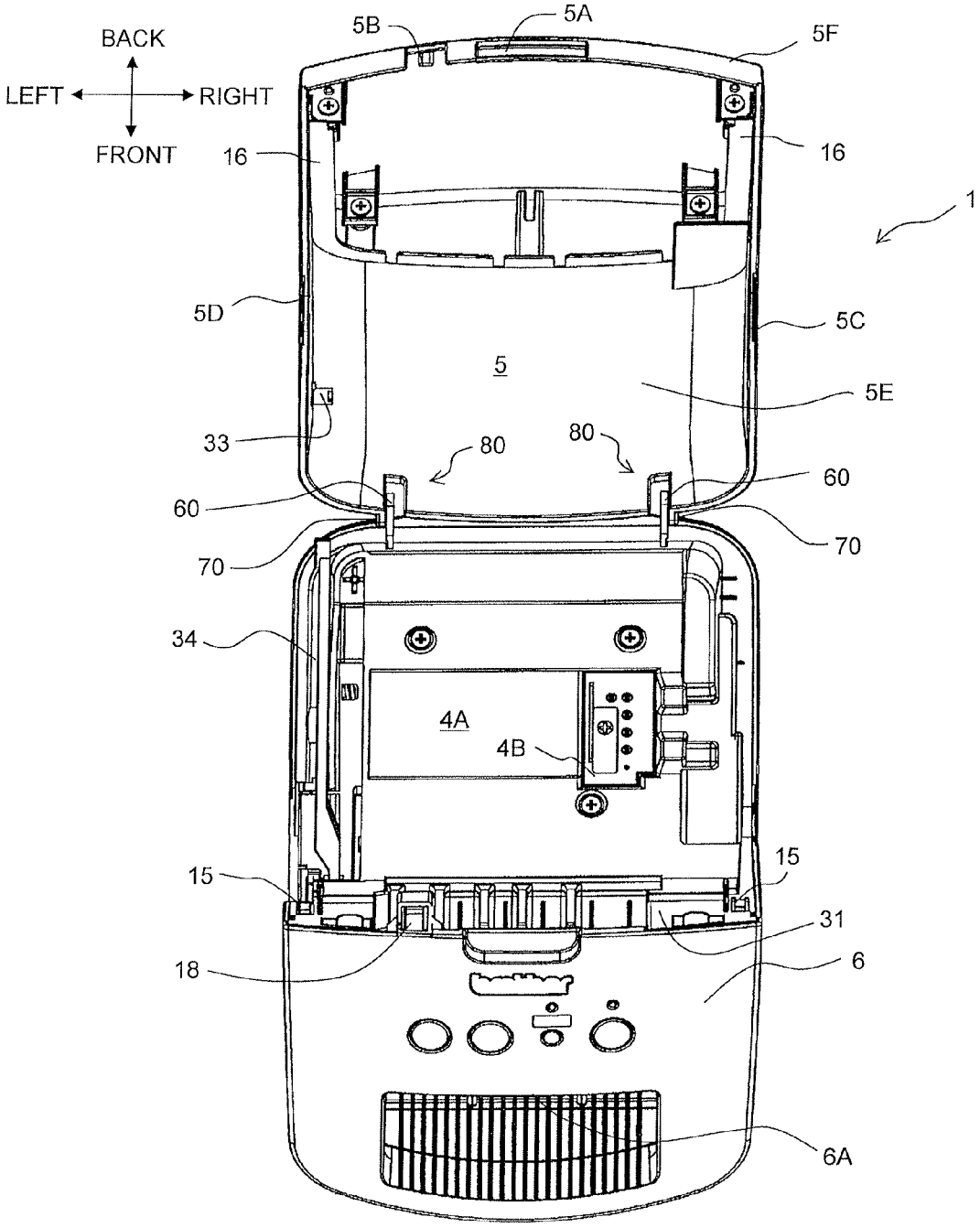
FIG. 7 is a plan view illustrating the print label producing apparatus with the opening/closing cover further opened from the state illustrated in FIG. 6 and with a link lever released.
Figure 17A:
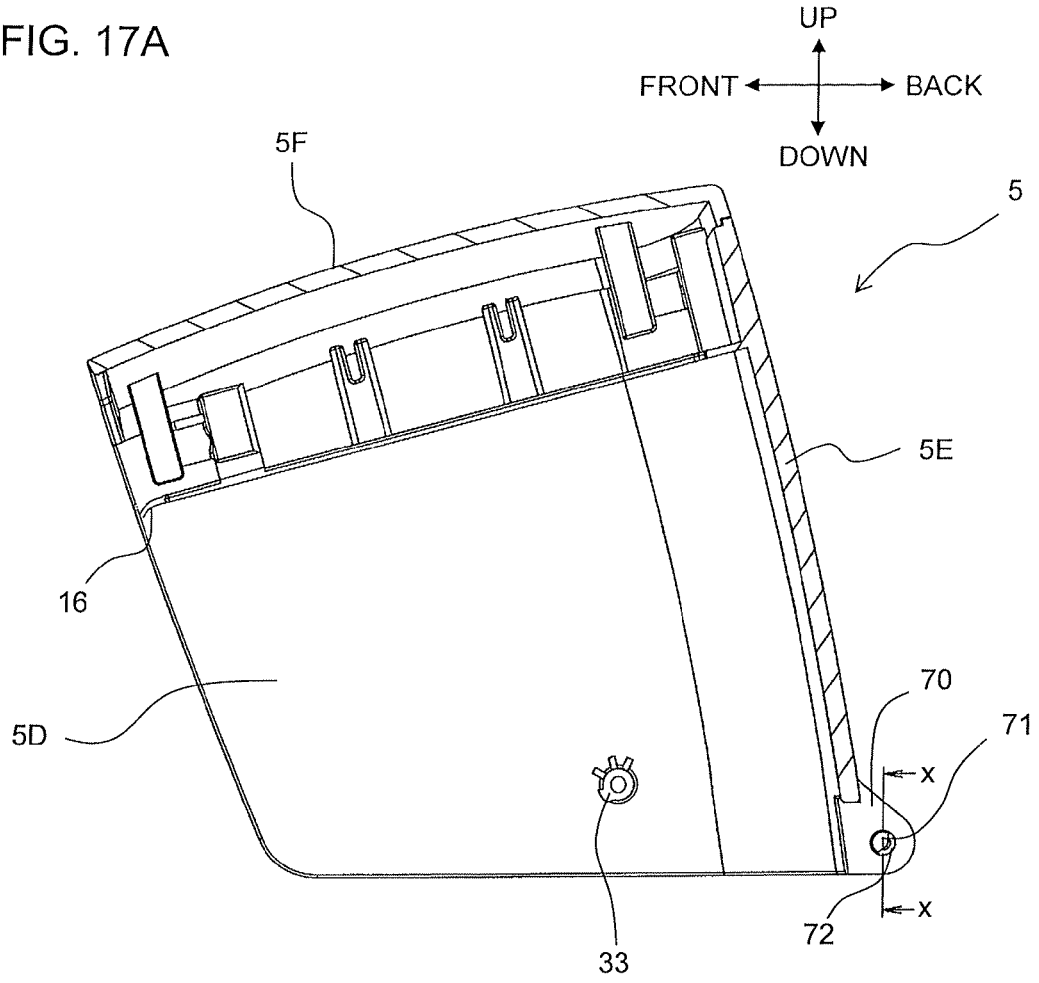
FIG. 17A is a side cross-sectional view taken along a z-z line in FIG. 16.
Figure 17B:
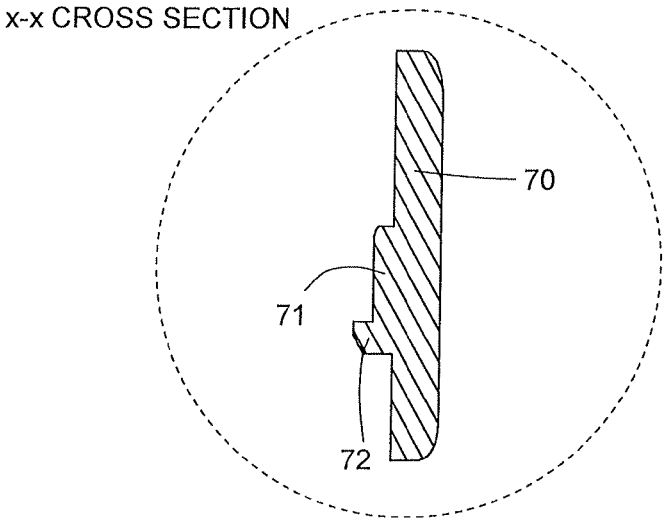
FIG. 17B is an enlarged cross-sectional view taken along an x-x line in FIG. 17A.
Figure 18:
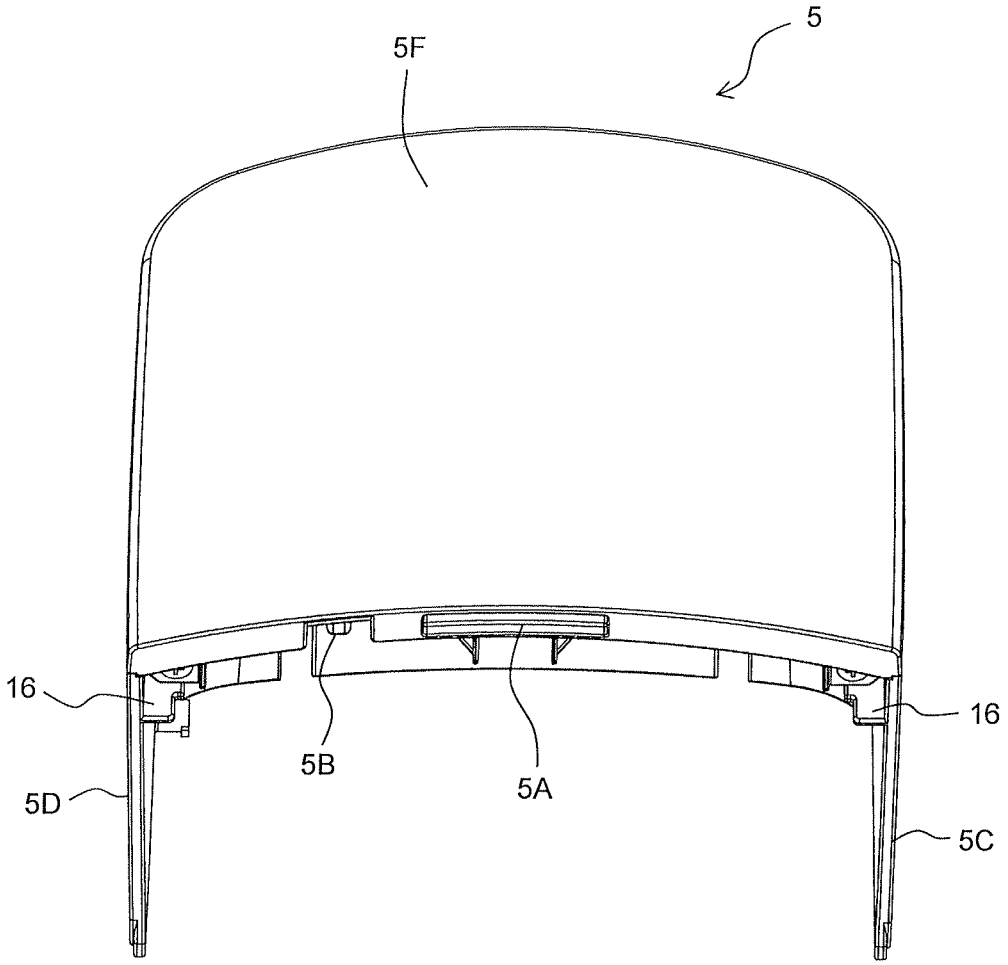
FIG. 18 is an enlarged plan view of the opening/closing cover extracted from FIG. 6.

As illustrated in FIG. 12 and FIGS. 6 to 10 described above, on a wall portion of the roll sheet holder storage unit 4 at a front side, engaging portions 15, 15 having a nail-like shape that is elastically, transformably formed are disposed. At a lower side of both right and left edges of a top plate 5F of the opening/closing cover 5, as illustrated in FIGS. 6, 7 (also refer to FIGS. 17, 19 described below), engaged portions 16, 16 having a horizontal-rib-like shape are disposed to face the engaging portions 15, 15. In FIG. 4 described above, the engaging portion 15 and the engaged portion 16 are not illustrated. When the opening/closing cover 5 is rotated in the forward direction, each engaging portion 15 and each engaged portion 16 are engaged with each other with a closed state of the opening/closing cover 5 retained. Further, when a recessed portion 5A formed at a center portion of a front edge of the opening/closing cover 5 is pressed with a finger to rotate in a backward direction, engagement between each engaging portion 15 and each engaged portion 16 is released to open the opening/closing cover 5.

<Vertical Movement of Thermal Head>

A mechanism for vertically moving the thermal head 32 in conjunction with opening/closing of the opening/closing cover 5 will be described below.

Figure 8:
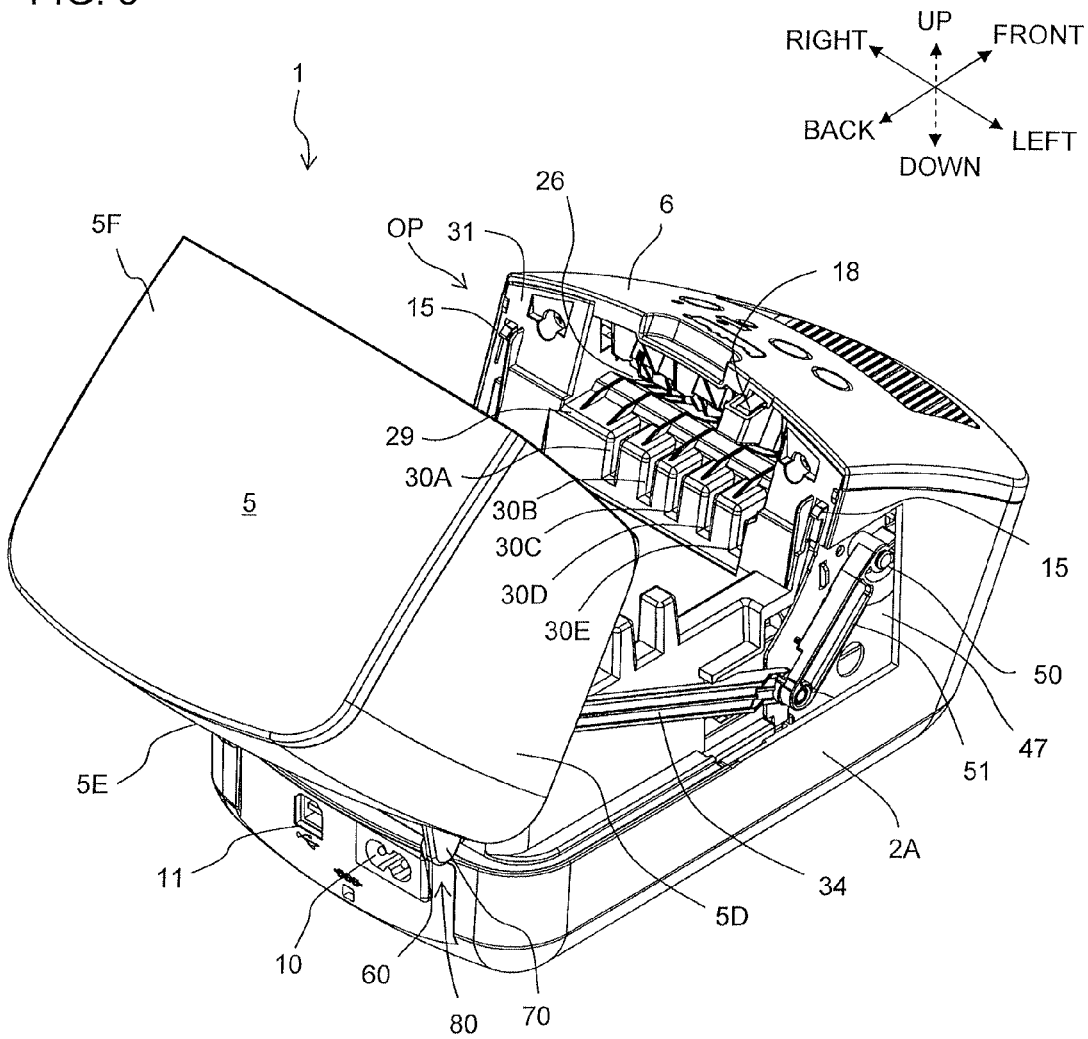
FIG. 8 is a perspective view illustrating the print label producing apparatus with the opening/closing cover opened viewed from left back.
Figure 9:
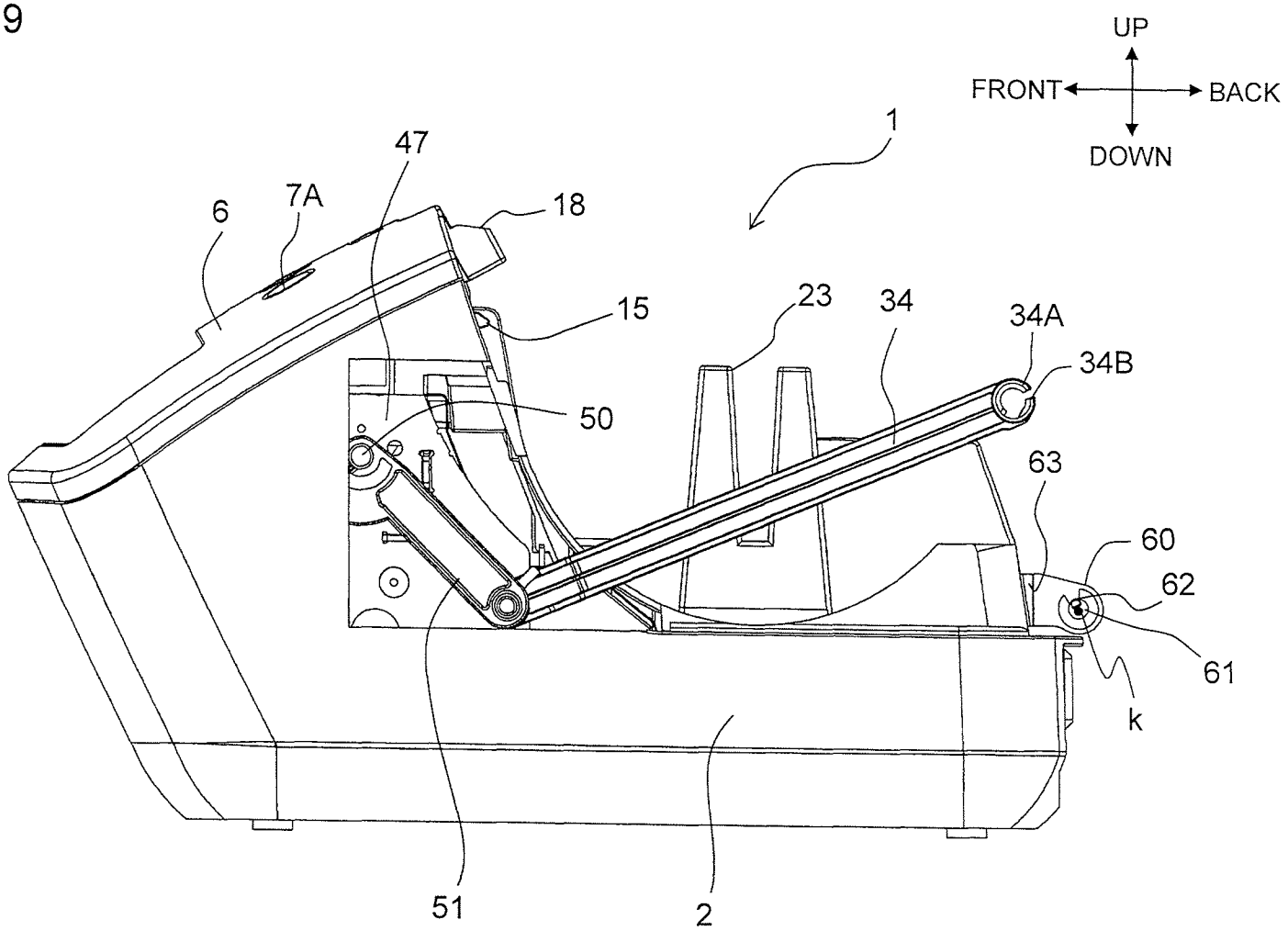
FIG. 9 is a left side view illustrating the print label producing apparatus with the opening/closing cover removed.

As described with reference to FIGS. 5, 8, 9 above, a left-side frame 47 pivotally supporting a left-side edge end portion of the roller shaft 35A of the platen roller 35 pivotally supports a left-side edge end portion of a release shaft 48 (refer to FIGS. 13, 14 and 5) for causing the thermal head 32 to vertically move as described below, and protrudes in an outside direction by a predetermined length. Further, on the left-side edge end portion of the release shaft 48, a release gear (not illustrated) formed with a gear is mounted on an approximately half periphery portion of an outer periphery.

Further, on the left-side frame 47, the lever shaft 50 is elevationally provided to the back side of the release gear and inserted into a through hole (not illustrated) drilled in a thickness direction at one edge of the release lever 51 so as to rotatably support the release lever 51. Of the outer periphery at a side of the through hole of the release lever 51, approximately half periphery portion facing the release gear when the opening/closing cover 5 is closed is formed with a lever gear (not illustrated) to be meshed with the release gear.

At an upper side portion of the lever gear of the release lever 51, an abutment piece (not illustrated) that can be abutted on a portion where a gear of the release gear is not formed is protrudingly disposed. With this arrangement, when the release lever 51 is rotated in the backward direction to almost release the mesh between the lever gear and the release gear, the abutment piece is abutted on the release gear to restrict the rotation of the release lever 51.

As described above, when the opening/closing cover 5 is closed, the link lever 34 is moved in the forward direction in conjunction with the movement of the opening/closing cover 5, the release lever 51 is rotated in a counter clockwise direction in a left-side face view about the lever shaft 50, and thus the release gear is rotated by approximately 180 degrees in a clockwise direction in the left-side face view via the lever gear.

Figure 13:
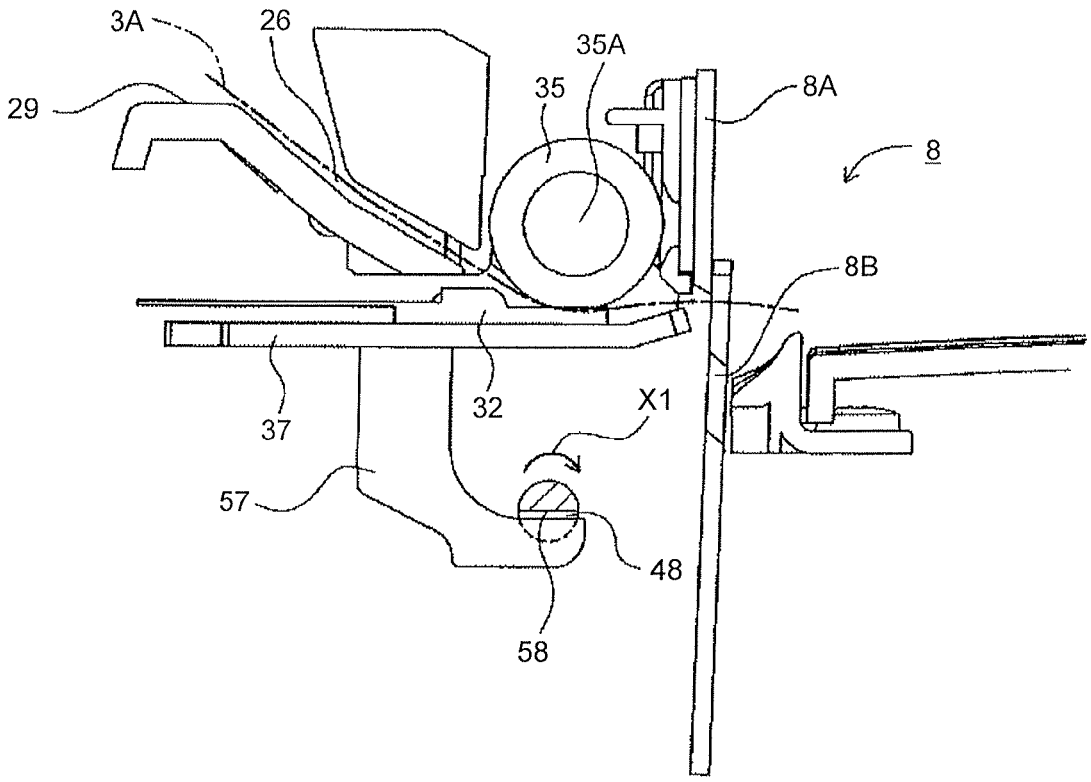
FIG. 13 is an enlarged side cross-sectional view of an essential portion illustrating a state where a thermal head is pressed and urged to a platen roller.

As illustrated in FIG. 13, with this arrangement, when the release gear is rotated by approximately 180 degrees in the clockwise direction in the left-side face view, a release shaft in which the left-side edge end portion is mounted to the release gear is also rotated by approximately 180 degrees in the clockwise direction in the left-side face view (arrow X1 direction in FIG. 13). A tip end of a lower portion interference member 57 (refer to FIG. 5 also) having a substantially L shape in a side face view disposed on a lower face portion of the head supporting member 37 is located below the notch face 58 of the release shaft 48. Therefore, since the tip end of the lower portion interference member 57 is not pressed downwardly by the release shaft 48, the head supporting member 37 is upwardly rotated by the pressing spring 36 so that the thermal head 32 presses and urges the roll sheet 3A onto the platen roller 35 to get ready for printing.

On the other hand, as described with reference to FIGS. 4, 6, 8 above, when the opening/closing cover 5 is opened, the link lever 34 is moved in the backward direction in conjunction with a movement of the opening/closing cover 5 so that the release lever 51 is rotated in the clockwise direction in the left-side face view about the lever shaft 50. Along with the rotation of the release lever 51, the release gear is rotated by approximately 180 degrees in the counter clockwise direction in the left-side face view via the lever gear. A lower edge portion of the release lever 51 is abutted on an outer peripheral portion of an insertion hole to regulate an opening angle of the opening/closing cover 5. A predetermined gap is formed between the abutment piece protrudingly disposed to an upper side of the lever gear of the release lever 51 and the release gear.

Figure 14:
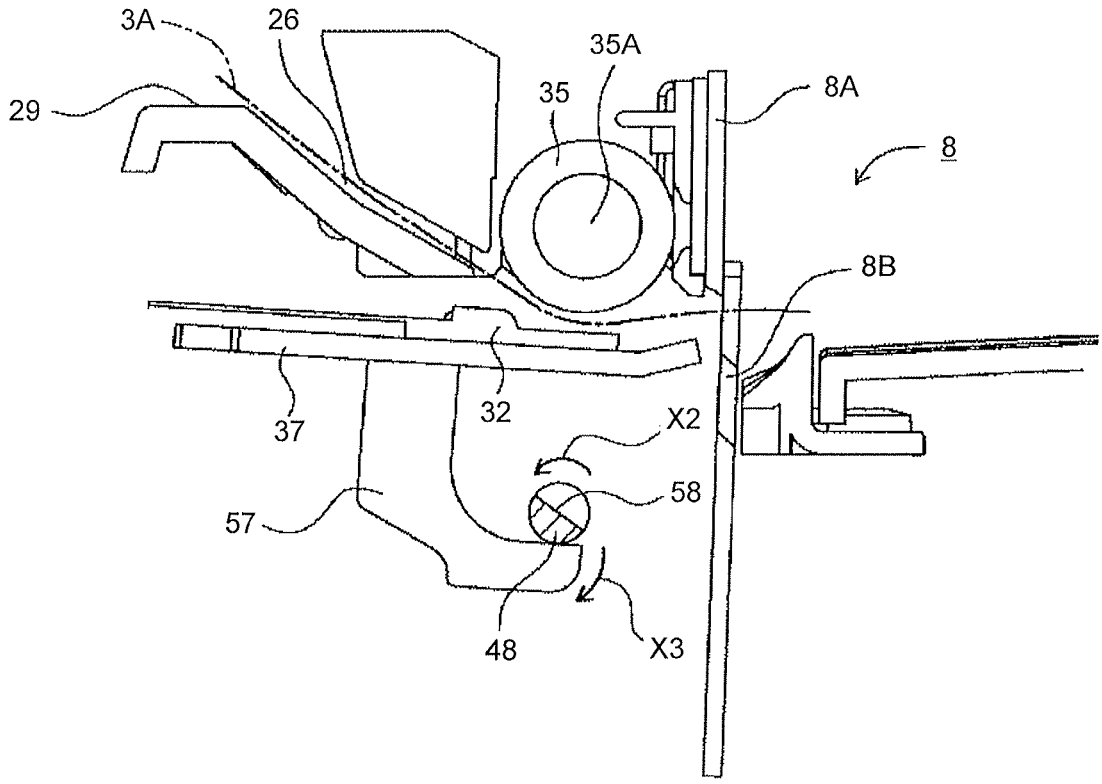
FIG. 14 is an enlarged side cross-sectional view of the essential portion illustrating a state where the thermal head is separated away from the platen roller.
Figure 15:
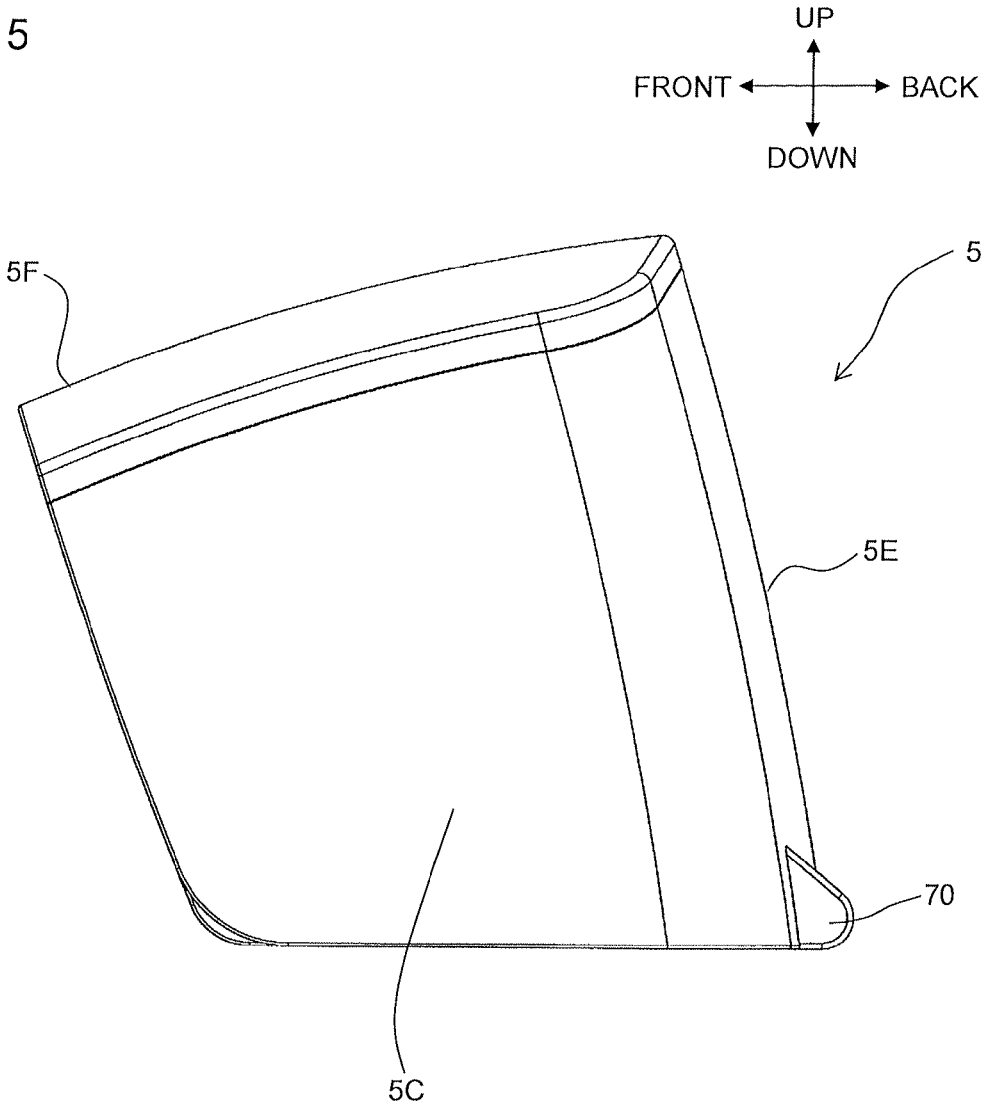
FIG. 15 is a right side view illustrating the opening/closing cover in a closed state corresponding to a state where the opening/closing cover is extracted from a structure illustrated in FIG. 1.
Figure 16:
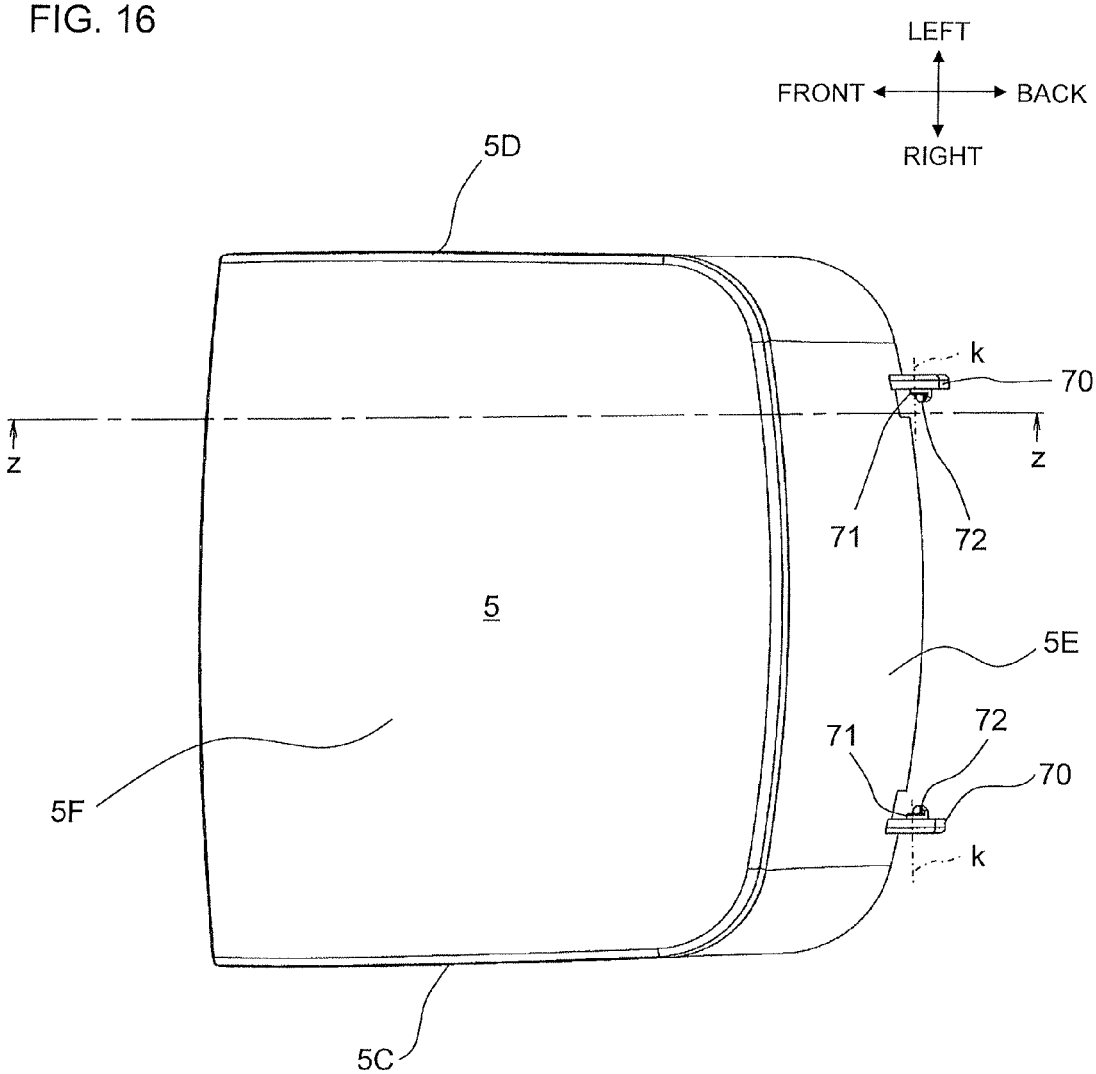
FIG. 16 is a plan view illustrating the opening/closing cover.

With this arrangement, when the release gear is rotated by approximately 180 degrees in the counter clockwise direction in the left-side face view, the release shaft 48 in which the left-side edge end portion is mounted to the release gear is also rotated by approximately 180 degrees in the counter clockwise direction in the left-side face view (arrow X2 direction in FIG. 14). The tip end of the lower portion interference member 57 having a substantially L shape in the side face view disposed on a lower face portion of the head supporting member 37 is pressed downwardly on a side face of a cylinder of the release shaft 48 (arrow X3 direction in FIG. 14). Therefore, the head supporting member 37 is rotated downwardly against an urging force of the pressing spring 36, the thermal head 32 is separated away from the platen roller 35, the roll sheet 3A is inserted through the insertion opening 26 to get ready for being further inserted between the platen roller 35 and the thermal head 32.

<Engagement Release Structure of Opening/Closing Cover>

The feature of the present embodiment including the basic configuration described above is a structure of the hinge portion 80 capable of releasing the engagement between the opening/closing cover 5 and the housing 2, when the excessive load is erroneously applied to the opening/closing cover 5. Content of the structure will be described in order below.

As illustrated in FIGS. 1, 2, 3, 7, 8, the hinge portion 80 includes the pair of the right and left hinge brackets 70, 70 disposed protrudingly from a back edge of an intermediate wall face 5E of the opening/closing cover 5, and the pair of the right and left hinge arms 60, 60 that are disposed protrudingly from a back edge of the housing main body 2A and cause the hinge brackets 70, 70 to be rotatably inserted therein.

Figure 19A:
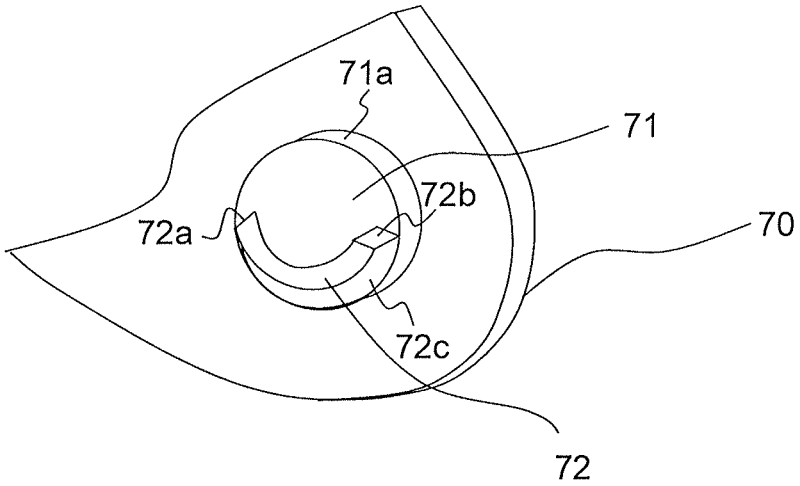
FIG. 19A is a perspective view illustrating a detailed structure of an essential portion of a hinge bracket of the opening/closing cover.

The pair of the right and left hinge brackets 70, 70 are, as illustrated in FIGS. 15 to 18, disposed such that shaft main bodies 71 each having a substantially columnar shape and the above described axis "k" as a center shaft are faced inside to face each other. Further, as illustrated in FIG. 19A, in a part of an area (e.g., semi-circular arc area) of a head edge face of the shaft main body 71 in a circumferential direction, a protruding portion 72 is protrudingly disposed to the shaft direction of the axis "k" from the peripheral edge portion of the shaft main body 71. A side of an edge 72*a* along the circular arc of the protruding portion 72 is connected to a head edge face of the shaft main body 71, and a height dimension (dimension along the axis "k" direction) of a face of the protruding portion 72 is gradually increased toward a side of another edge 72*b* along a tilt face along the circular arc. At the side of the another edge 72*b* along the circular arc of the protruding portion 72, the height dimension of the face of the protruding portion 72 is substantially same as that of an inner periphery of a hole of a hole main body 61 of the hinge arm 60 described below. Furthermore, an outer peripheral portion 72*c* of the protruding portion 72 is chamfered to tilt in a radial direction to connect to an outer peripheral portion 71*a* of the shaft main body 71.

Figure 19B:
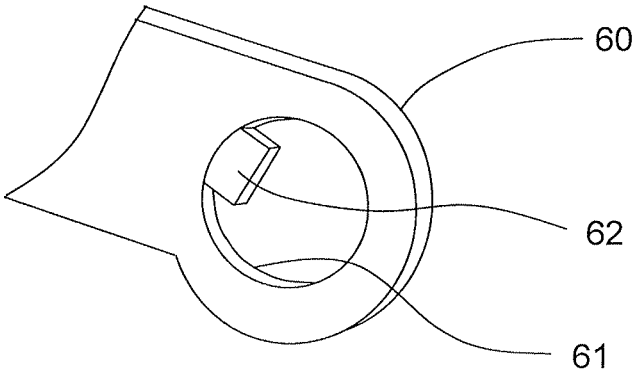
FIG. 19B is a perspective view illustrating a detailed structure of an essential portion of a hinge arm of a housing.

As described with reference to FIGS. 9 to 12, the pair of the right and left hinge arms 60, 60 are provided to slidably store and support the pair of right and left shaft main bodies 71, 71 from an outside in the right-and-left direction, and the hole main body 61 having the axis "k" corresponding to the shaft main body 71 of the hinge bracket 70 as the center shaft is drilled in the hinge arm 60. In other words, an inner diameter of the hole main body 61 and an outer diameter of the shaft main body 71 are substantially the same as each other, and the hole main body 61 and the shaft main body 71 are engaged with each other rotatably about the same axis "k" as sliding with each other. As illustrated in FIG. 19B, in a part of an area (e.g., semi-circular arc area) of the hole main body 61 in a circumferential direction, a protruding portion 62 having a rectangular-plate like shape is disposed protrudingly toward an inside in the radial direction from the peripheral edge portion of the hole main body 61. A thickness of the protruding portion 62 is the same as the height of the hinge arm 60.

Figure 10:
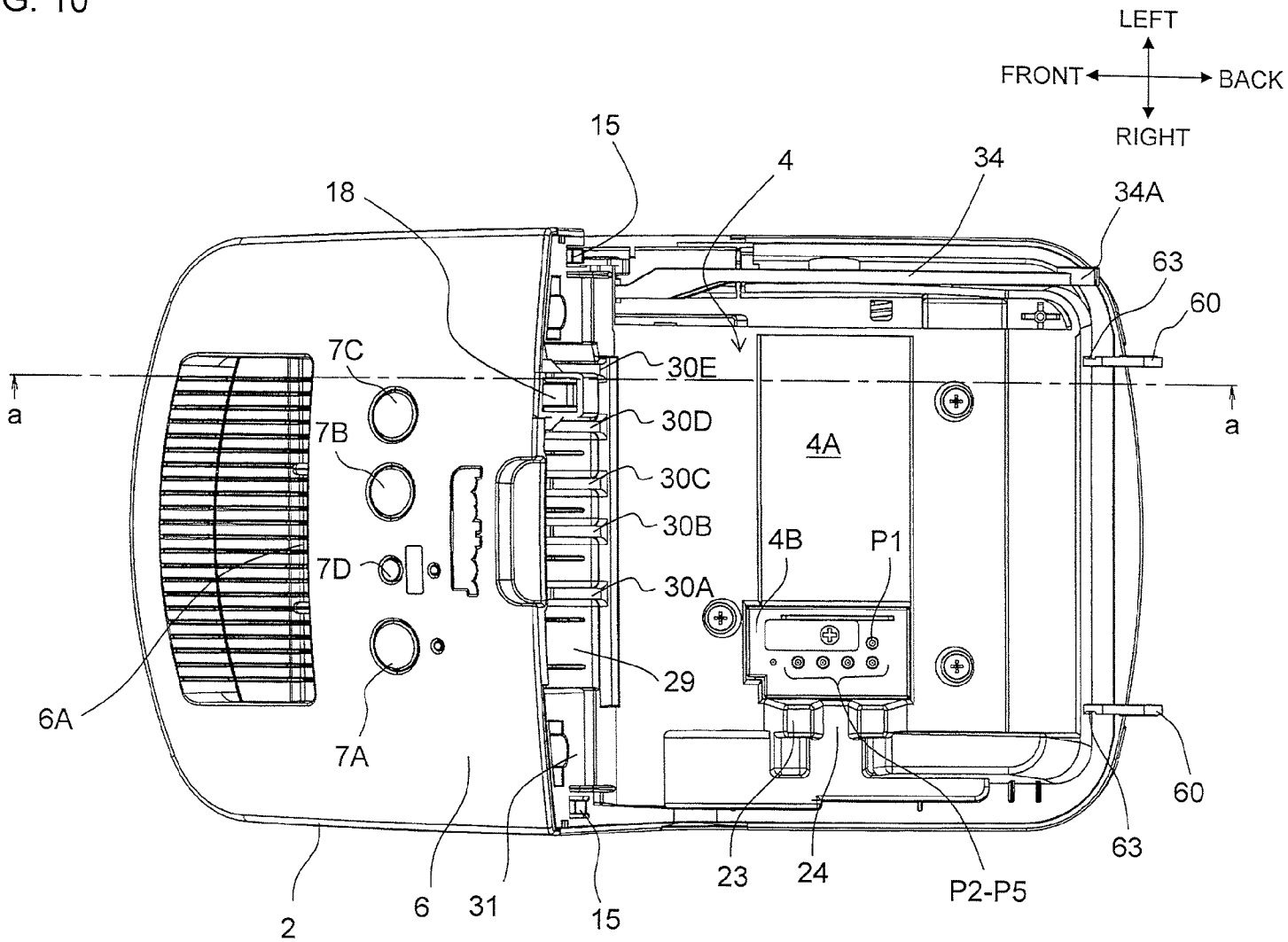
FIG. 10 is a plan view illustrating the print label producing apparatus with the opening/closing cover removed.
Figure 12:
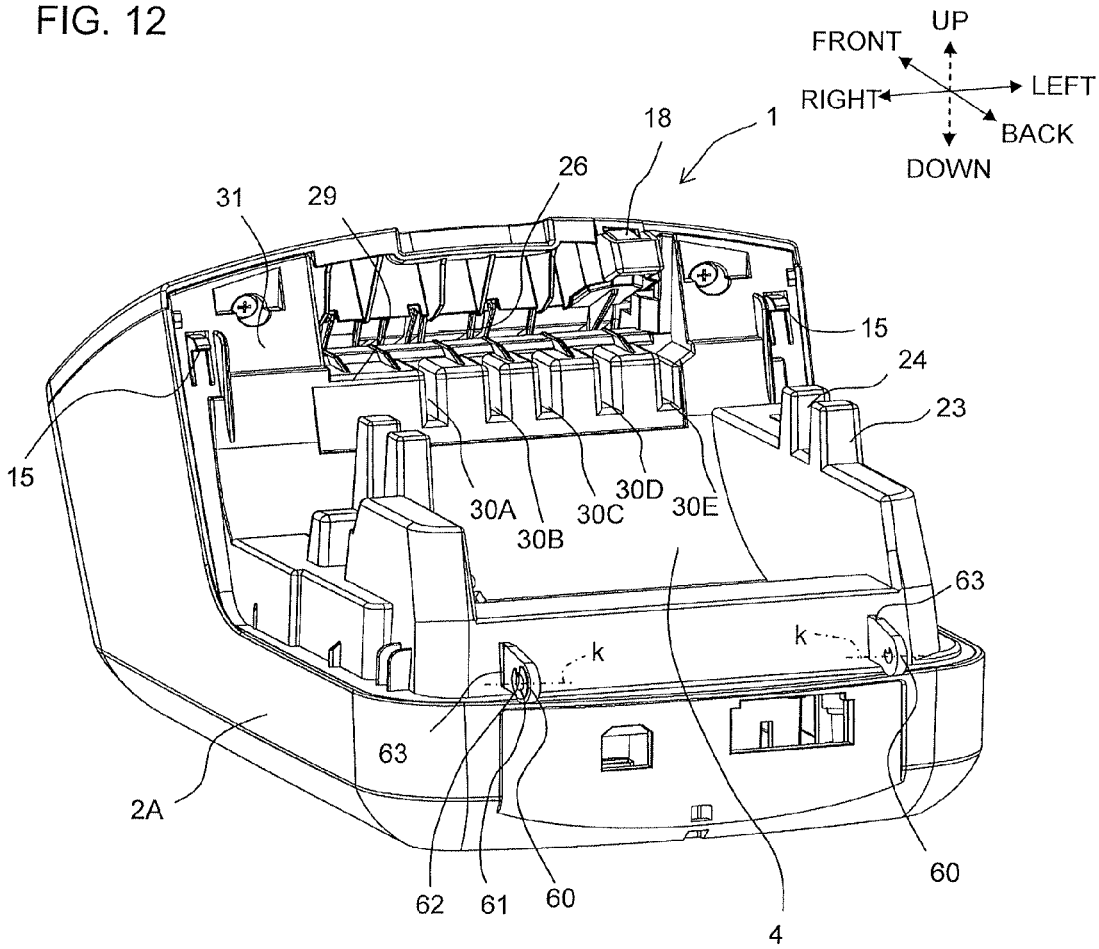
FIG. 12 is a perspective view illustrating the print label producing apparatus with the opening/closing cover removed.

As described with reference to FIGS. 9, 10, 12, etc. above, at the outside in the right-and-left direction of a basic edge portion (vicinity of a connection portion with the housing main body 2A) of the pair of the right and left hinge arms 60, 60, a slit 63 that has a groove-like shape and is extendedly disposed to the vertical direction with a predetermined width, for example, is disposed. With this arrangement, the pair of the right and left hinge arms 60, 60 are configured to easily warp to the inside in the right-and-left direction than to the outside therein.

<Details of Engagement Release Action Caused by Overriding of Protruding Portion>

Overriding actions of the protruding portion 72 and the protruding portion 62 along with movement from the closed state of the opening/closing cover 5 to the open state thereof will be described with reference to FIGS. 20 to 29.

Figure 20:
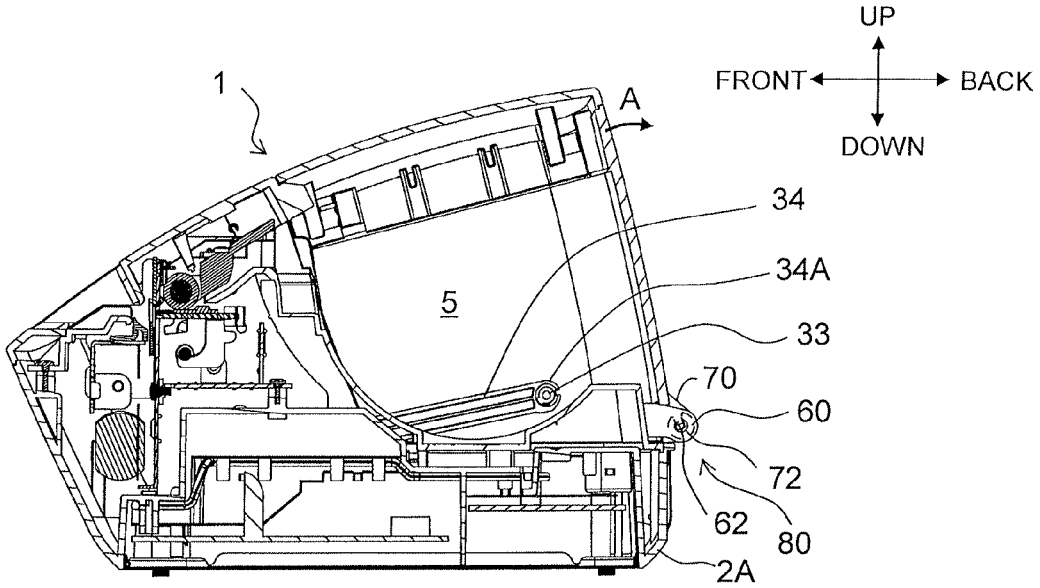
FIG. 20 is a side cross-sectional view illustrating the print label producing apparatus with the opening/closing cover closed.
Figure 25:
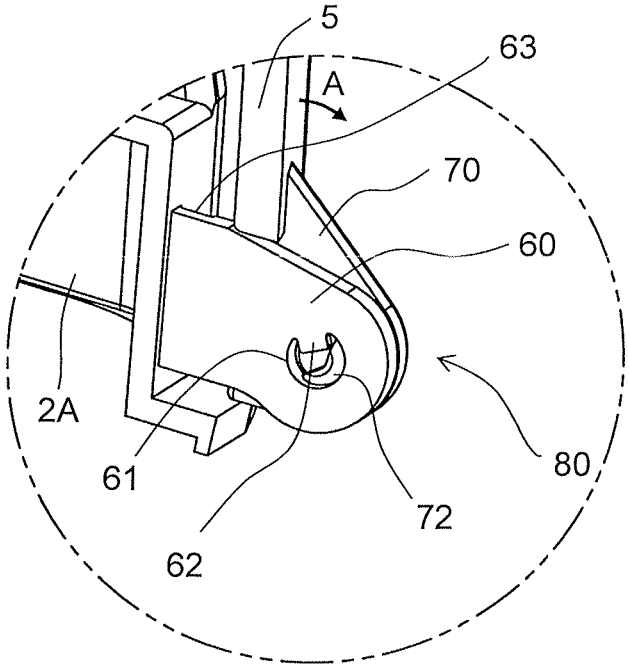
FIG. 25 is an enlarged perspective view of an essential part illustrating an engagement state of a hinge portion (at a right side of a pair of right and left) at a rotation position of the opening/closing cover illustrated in FIG. 20.

When the opening/closing cover 5 is closed, as illustrated in FIGS. 20 and 25, the protruding portion 72 of the hinge bracket 70 of the opening/closing cover 5 and the protruding portion 62 of the hinge arm 60 of the housing 2 are separated away from each other in the circumferential direction.

Figure 21:
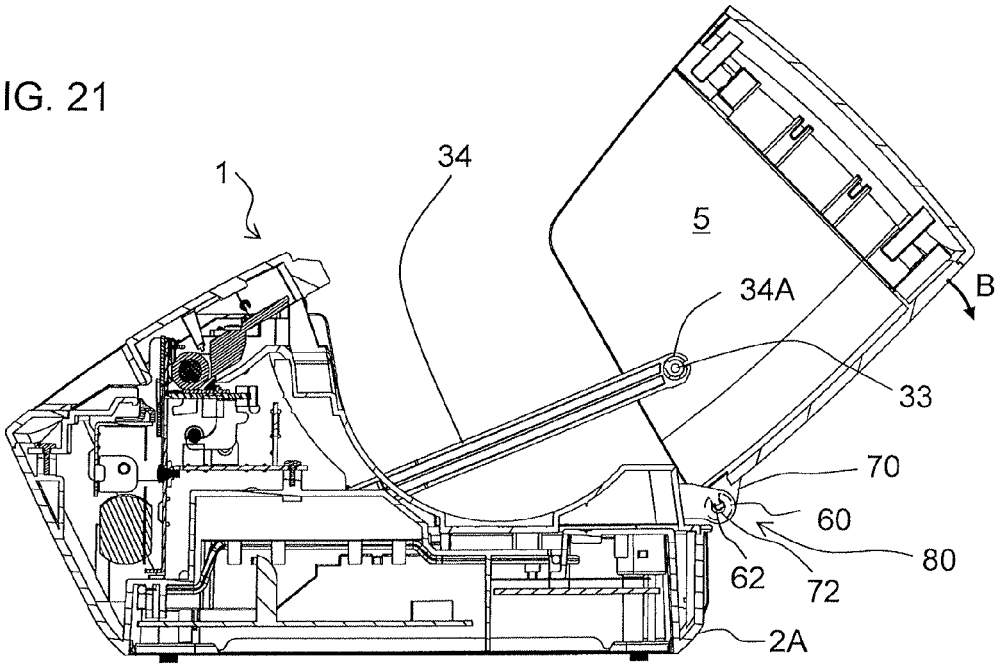
FIG. 21 is a side cross-sectional view illustrating a state where the opening/closing cover is rotated in an opening direction from the state in FIG. 20 and an engagement nail portion of the link lever is nearly released from an engagement shaft of the opening/closing cover.
Figure 26:
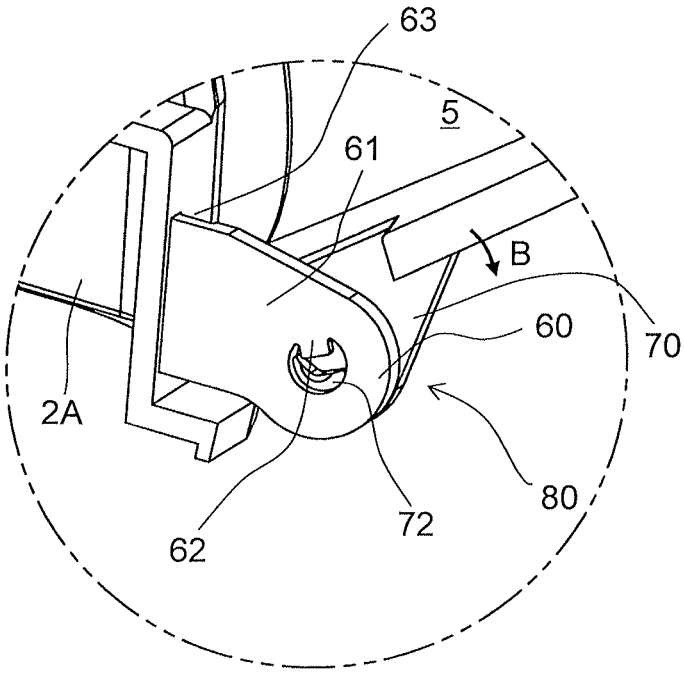
FIG. 26 is an enlarged perspective view of an essential part illustrating an engagement state of a hinge portion (at a right side of a pair of the right and left) at a rotation position of the opening/closing cover illustrated in FIG. 21.

Subsequently, as the opening/closing cover 5 is rotated in the opening direction (refer to an arrow A in FIGS. 20, 25), as illustrated in FIGS. 21 and 26, the protruding portion 72 of the hinge bracket 70 moves in the circumferential direction (according to this embodiment, in the clockwise direction, refer to FIG. 26) inside the hole main body 61 of the hinge arm 60, so that a distance in the circumferential direction between the protruding portion 72 of the hinge bracket 70 and the protruding portion 62 of the hinge arm 60 is reduced.

Further subsequently, the opening/closing cover 5 is rotated in the opening direction (refer to an arrow B in FIGS. 21, 26) to arrive at a certain third rotation position (not illustrated), the engagement nail portion 34A of the link lever 34 is removed from the engagement shaft 33 of the opening/closing cover 5 due to the notch portion 34B (i.e., the engagement shaft 33 is separated away outside the engagement nail portion 34A disposed outer than the notch portion 34B, refer to FIG. 22 described below).

Figure 22:
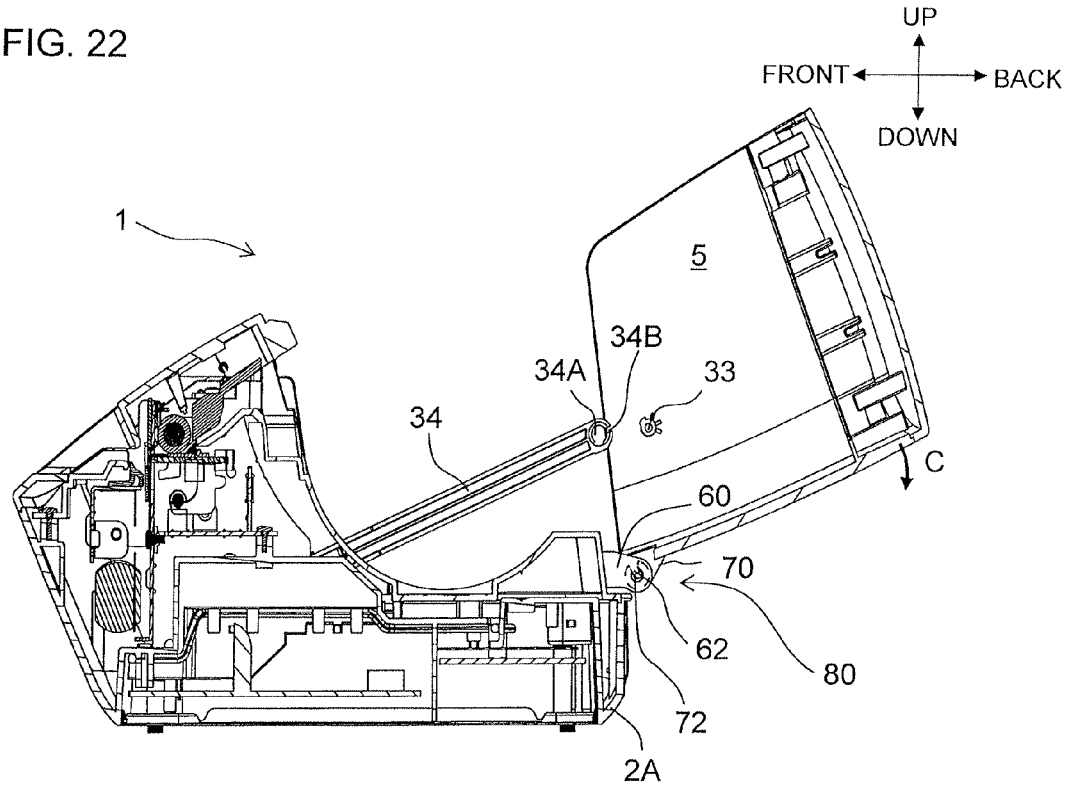
FIG. 22 is a side cross-sectional view illustrating a state where the opening/closing cover is further rotated in the opening direction from the state in FIG. 21, and a protruding portion of the hinge bracket and a protruding portion of the hinge arm are abutted on each other in a circumferential direction.
Figure 27:
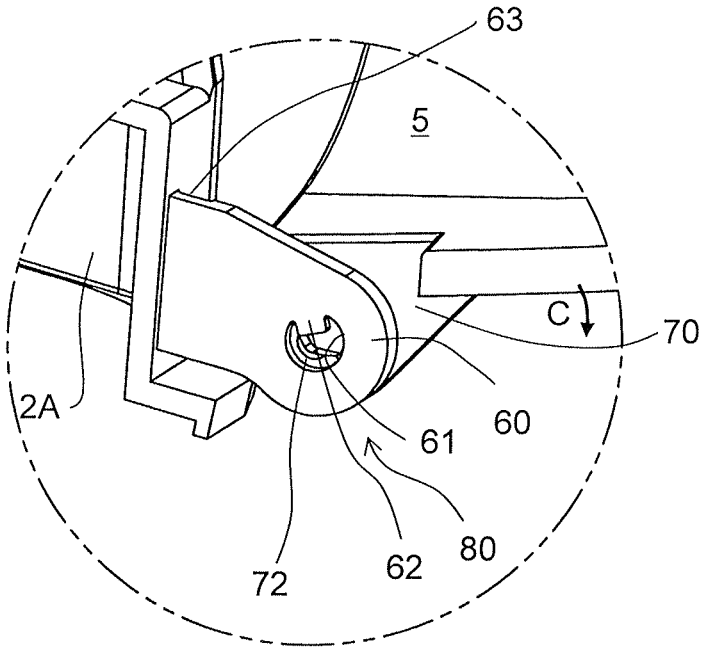
FIG. 27 is an enlarged perspective view of an essential part illustrating an engagement state of a hinge portion (at a right side of a pair of the right and left) at a rotation position of the opening/closing cover illustrated in FIG. 22.

When the opening/closing cover 5 is rotated in the opening direction, as illustrated in FIGS. 22 and 27, the protruding portion 72 of the hinge bracket 70 and the protruding portion 62 of the hinge arm 60 are abutted on each other in the circumferential direction (first rotation position). While the opening/closing cover 5 is located between the closed state (refer to FIGS. 20 and 25) and the first rotation position, the protruding portion 72 of the hinge bracket 70 is positioned inside the hole main body 61 of the hinge arm 60 in the radial direction.

Figure 23:
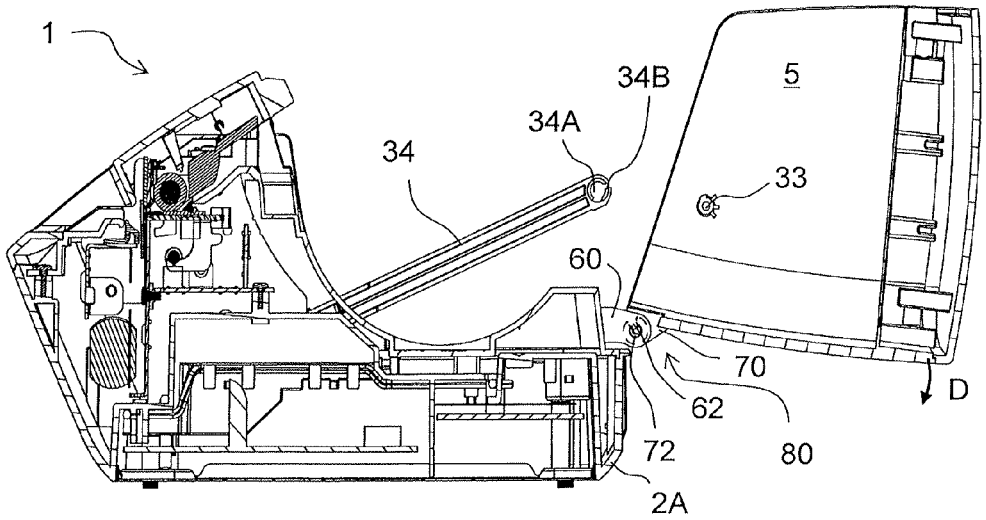
FIG. 23 is a side cross-sectional view illustrating a state where the opening/closing cover is further rotated in the opening direction from the state in FIG. 22, and the protruding portion of the hinge bracket starts to override the protruding portion of the hinge arm.
Figure 28:
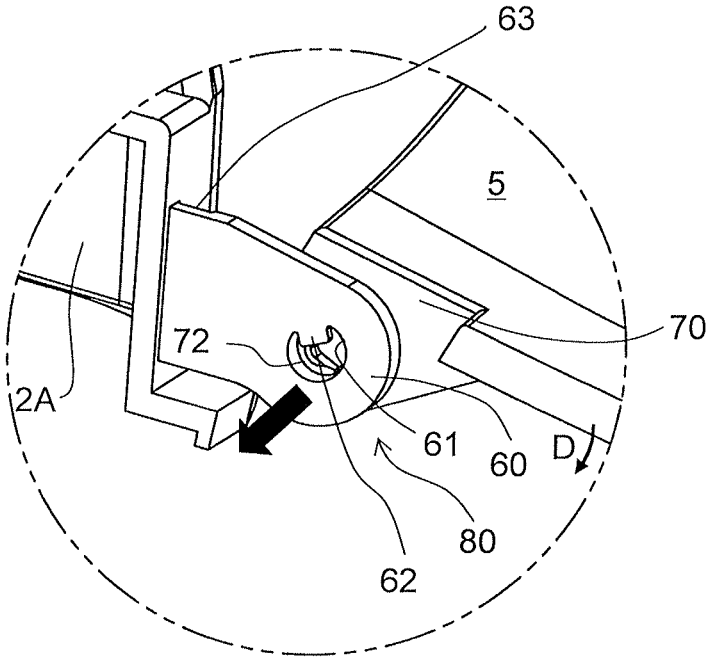
FIG. 28 is an enlarged perspective view of an essential part illustrating an engagement state of a hinge portion (at a right side of a pair of the right and left) at a rotation position of the opening/closing cover illustrated in FIG. 23.

Subsequently, when the opening/closing cover 5 is rotated in the opening direction (refer to the arrow C in FIGS. 22, 27) to arrive at a certain rotation position, as illustrated in FIGS. 23 and 28, the protruding portion 72 of the hinge bracket 70 that has moved in the circumferential direction as described above starts to override the protruding portion 62 of the hinge arm 60 and starts to overlap each other in the shaft direction of the axis "k". As illustrated in FIG. 28, the protruding portion 72 partially overlaps the protruding portion 62 and is located at another side of the protruding portion 62 in a right inner direction. At this point, the protruding portion 72 of the hinge bracket 70 overrides the protruding portion 62 so that the hinge arm 60 is warped inside in the right-and-left direction (refer to a bold arrow in FIG. 28). In other words, this embodiment is previously configured such that rigidity of the hinge arm 60 is smaller than that of the hinge bracket 70 (the hinge bracket 70 is not warped but the hinge arm 60 is warped). Further, along with the rotation of the opening/closing cover 5 in the opening direction (refer to an arrow D in FIGS. 23, 28), the protruding portion 72 further overrides the protruding portion 62, so that an entire area of the protruding portion 72 in the circumferential direction overrides the protruding portion 62, the protruding portion 72 and the protruding portion 62 overlap each other in the shaft direction of the shaft "k", and finally the protruding portion 72 is separated away outside the hole main body 61. With this arrangement, the engagement between the hinge bracket 70 and the hinge arm 60 (i.e., engagement between the opening/closing cover 5 and the housing 2) is released.

Figure 24:
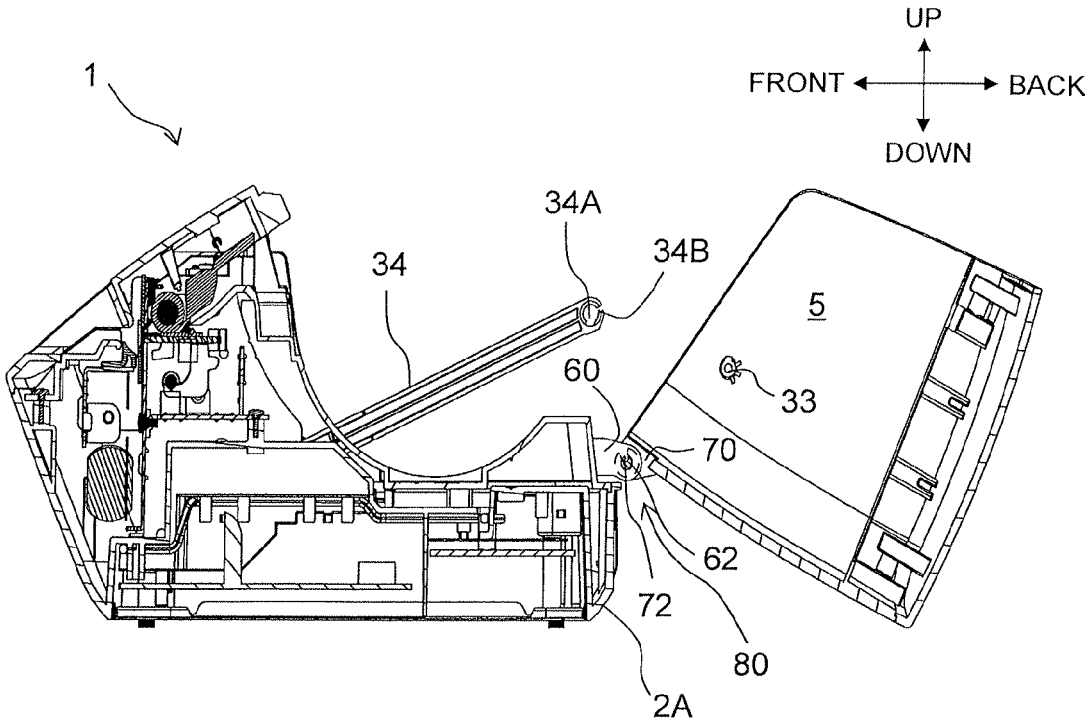
FIG. 24 is a side cross-sectional view illustrating a state where the opening/closing cover is further rotated in the opening direction from the state in FIG. 23, and the hinge bracket of the opening/closing cover is nearly released from the hinge arm of the housing.
Figure 29:
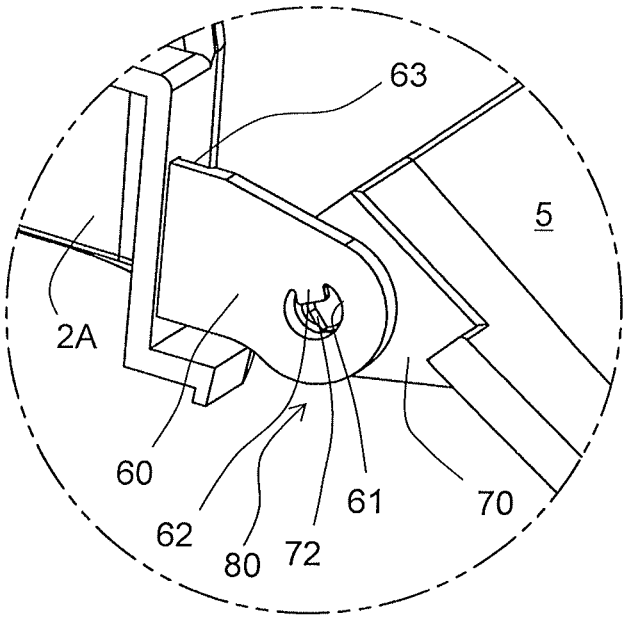
FIG. 29 is an enlarged perspective view of an essential part illustrating an engagement state of a hinge portion (at a right side of a pair of the right and left) at a rotation position of the opening/closing cover illustrated in FIG. 24.

FIGS. 24 and 29 illustrate a state right before the engagement is released as described above. A range of a rotation position of the opening/closing cover 5 since the protruding portion 72 has started to override the protruding portion 62 as illustrated in FIGS. 23 and 28 until right before the engagement is released as illustrated in FIGS. 24 and 29 is defined as a second rotation position.

As described above, according to the present embodiment, the opening/closing cover 5 for opening/closing the opening portion OP of the housing 2 is rotatably supported with respect to the housing 2 via the engagement structure between the hinge bracket 70 and the hinge arm 60. At this point, so as to release the engagement depending on the rotation position of the opening/closing cover 5, the protruding portion 72 is provided on a part of the area of the shaft main body 71 of the hinge bracket 70 in the circumferential direction, the protruding portion 62 is provided on a part of the area of the hole main body 61 of the hinge arm 60 in the circumferential direction. When the opening/closing cover 5 is closed, the protruding portion 72 and the protruding portion 62 are separated away from each other in the circumferential direction (refer to FIGS. 20 and 25), and when the opening/closing cover 5 is rotated in the opening direction to arrive at the first rotation position, the protruding portion 72 and the protruding portion 62 are abutted on each other (refer to FIGS. 22 and 27). Further, when the opening/closing cover 5 is rotated in the opening direction to arrive at the second rotation position, the protruding portion 72 and the protruding portion 62 overlap each other in the shaft direction of the axis "k" such that the protruding portion 72 overrides the protruding portion 62 (refer to FIGS. 23 and 28, and FIGS. 24 and 29). With this arrangement, the relative position in the shaft direction between the hinge bracket 70 and the hinge arm 60 that have been engaged with each other is changed and the engagement between the hinge bracket 70 and the hinge arm 60 is loosened to be ready for releasing the engagement. As described above, when the rotation angle of the opening/closing cover 5 is increased to a certain angle, the engagement between the hinge bracket 70 and the hinge arm 60 is released to remove the opening/closing cover 5 from the housing 2. As a result, even when the excessive load is erroneously applied to the opening/closing cover 5, the opening/closing cover 5 is removed from the housing 2 to remove the excessive load, thereby preventing the opening/closing cover 5 and the housing 2 from being damaged.

Further, according to the present embodiment, particularly, during the period from when the opening/closing cover 5 is in the closed state to when it arrives at the first rotation position (refer to FIGS. 22, 27), the protruding portion 72 of the shaft main body 71 of the hinge bracket 70 is positioned inside the hole main body 61 of the hinge arm 60 in the radial direction. With this arrangement, while the opening/closing cover 5 is located between the closed state and the first rotation position, the opening/closing cover 5 can be smoothly opened/closed in a state where the engagement between the hinge bracket 70 and the hinge arm 60 is reliably maintained. Further, since the protruding portion 72 is not outwardly protruded, even when a hand comes in contact with the hinge portion 80, the hand can be kept safe without being hurt.

According to the present embodiment, particularly, when the opening/closing cover 5 is rotated from the first rotation position (refer to FIGS. 22, 27) to arrive at the second rotation position, the hinge arm 60 is warped (refer to FIGS. 23, 28) inside in the right-and-left direction. Therefore, the protruding portion 72 overrides the protruding portion 62 to overlap the protruding portion 62 in the shaft direction of the axis "k", and thus the protruding portion 72 and the protruding portion 62 can reliably overlap each other in the shaft direction. At this point, since the hinge arm 60 disposed protrudingly from the housing 2A is longer than the hinge bracket 70 of the opening/closing cover 5, the hinge arm 60 can be easily made elastic and warped.

Further, according to the present embodiment, particularly, the hinge arm 60 of the housing 2 has the slit 63. With this slit, since the hinge arm 60 can be easily warped inside in the right-and-left direction when the overriding is performed, the protruding portion 72 and the protruding portion 62 can be further reliably overlapped with each other.

According to the present embodiment, particularly, when the link lever 34 and the opening/closing cover 5 are to be engaged with each other, as the engagement nail portion 34A of the link lever 34 exposes a part of the engagement shaft 33 of the opening/closing cover 5, it covers most of other portions. With this arrangement, when a large load is applied, the engagement nail portion 34A is elastically transformed to enlarge a part (notch portion 34B that is a non-covered portion) that exposes the engagement shaft 33 without covering it to separate away the engagement shaft 33 from the notch portion 34B outside the engagement nail portion 34A. Therefore, when the excessive load is erroneously applied to the opening/closing cover 5, as described above, the opening/closing cover 5 is removed from the housing 2, and in addition, the opening/closing cover 5 is also removed from the link lever 34. As a result, the opening/closing cover 5 and the housing 2 can be further reliably prevented from being damaged. Since the opening/closing cover 5 is removed from the link lever 34, a connection structure among the release lever 51, the release gear (not illustrated), the release shaft 48, and the lower portion interference member 57 positioned at the side edge portion of another side of the link lever 34 is not released or damaged. As a result, the engagement nail portion 34A that is separated away is elastically transformed to be expanded and then engaged with the engagement shaft 33, so that the connection structure can be easily recovered to an original state.

According to the above described present embodiment, a shaft main body 71 and a protruding portion 72 are provided on a hinge bracket 70 of the opening/closing cover 5, and the hole main body 61 and the protruding portion 62 are disposed on the hinge arm 60 of the housing 2. However, on the other hand, the shaft main body 71, the protruding portion 72, and an equivalent structure may be disposed to a side of the housing 2, and the hole main body 61, the protruding portion 62, and an equivalent structure may be disposed on the hinge bracket 70 of the opening/closing cover 5 so that the engagement structure that can be released similarly to the above-described structure can be realized. In this case also, the similar effect can be obtained.

The present disclosure is applied to the print label producing apparatus, as the electronic device, for producing the print label by performing the desired printing on a print-receiving tape, but, the present disclosure is not limited thereto. For example, the present disclosure may be applied to a portable printer that can be driven by a battery power source, and printing apparatuses of other types including a printer that forms an image on a normal printing paper in a size such as A4, A3, B4 and B5 or prints characters thereon. Furthermore, the present disclosure is not limited to be applied to the print apparatus but can be applied to others such as the electronic device including the housing with the opening portion. In this case also, the similar effect can be obtained.

In addition to other cases than the above described cases, the above described embodiments and modification examples may be appropriately combined and used.

What is claimed is:

1. An electronic device comprising:

a housing that forms an outer frame of the device and includes an opening portion; and an opening/closing cover configured to open/close said opening portion, one of said opening/closing cover and said housing including a shaft portion having a predetermined axis, the other of said opening/closing cover and said housing including a bearing hole portion engaging with said shaft portion rotatably about said axis, said shaft portion including a first protruding portion in a part of an area in a circumferential direction of the shaft portion, said bearing hole portion including a second protruding portion in a part of an area in a circumferential direction of the bearing hole portion, and said first protruding portion and said second protruding portion being, configured to be separated away from each other in the circumferential direction when said opening/closing cover is in a closed state;

configured to become closer to each other in a distance in the circumferential direction along with rotation in an opening direction from said closed state of said opening/closing cover;

configured to be in contact with each other when the opening/closing cover arrives at a first rotation position; and configured to release an engagement of said shaft portion and said bearing hole portion by the manner that one of said first protruding portion and second protruding portion overrides the other of said first protruding portion and second protruding portion to overlap each other in a direction of said axis when the opening/closing cover is further rotated in said opening direction from said first rotation position to arrive at a second rotation position, wherein:

said shaft portion includes:

a shaft main body having a cylindrical shape; and said first protruding portion that protrudes in a direction of said axis from a peripheral edge portion of said shaft main body, said bearing hole portion includes:

a hole main body configured to slidably store said shaft main body; and main body; and said second protruding portion that protrudes to an inner side in a radial direction from a peripheral edge portion of said hole main body, and wherein during the period from when said opening/closing cover is in said closed state to when said opening/closing cover arrives at said first rotation position, said first protruding portion of said shaft portion is configured to position on the inner side of said hole main body of said bearing hole portion in the radial direction.

2. The electronic device according to claim 1, wherein:

said housing includes:

a housing main body; and an arm portion that is disposed protrudingly from said housing main body and includes said shaft portion or said bearing hole portion at a substantially tip end of the arm portion, wherein, when said opening/closing cover is rotated from said first rotation position to arrive at said second rotation position, one of said first protruding portion and said second protruding portion is configured to override the other of said first protruding portion and said second protruding portion, and said first protruding portion and said second protruding portion are configured to overlap each other in a direction of said axis by the manner that said arm portion is warped in a predetermined direction.

3. The electronic device according to claim 2, wherein:

said arm portion of said housing includes a rigidity reducing portion where warp is generated in said predetermined direction easier than in a direction opposite to said predetermined direction.

4. The electronic device according to claim 1, further comprising;

a feeding roller arranged inside said housing and configured to feed a print-receiving tape;

a printing head arranged inside said housing and configured to perform desired printing on said print-receiving tape fed by said feeding roller;

a pressing device arranged inside said housing and configured to press and urge said print-receiving tape by means of sandwiching said print-receiving tape with said feeding roller and said printing head;

a release device arranged inside said housing and configured to perform separation and compression of said feeding roller and said printing head; and a link lever configured to perform said separation and said compression by said release device in conjunction with an opening/closing action of said opening/closing cover, wherein said link lever includes:

an elastic engagement nail portion positioned to one side edge portion and configured to be engaged with said opening/closing cover; and the other side edge portion connected to said release device, said opening/closing cover including an engagement shaft configured to be engaged with said engagement nail portion of said link lever, and said engagement nail portion of said link lever is configured to expose a part of an outer peripheral portion of said engagement shaft while cover other part of the outer peripheral portion of said engagement shaft, and is configured to be removed from said engagement shaft at a third rotation position where said opening/closing cover is rotated in a closing direction further than in the first rotation position.

* * * * *